US009826322B2

(12) United States Patent
Shen et al.

(10) Patent No.: US 9,826,322 B2
(45) Date of Patent: Nov. 21, 2017

(54) ADJUSTABLE SECURING MECHANISM

(71) Applicant: Eargo, Inc, Mountain View, CA (US)

(72) Inventors: Daniel Shen, Stanford, CA (US); Florent Michel, Annemasse (FR); Raphael Michel, Palo Alto, CA (US)

(73) Assignee: Eargo, Inc., Mountain View, CA (US)

( * ) Notice: Subject to any disclaimer, the term of this patent is extended or adjusted under 35 U.S.C. 154(b) by 0 days.

(21) Appl. No.: 15/373,379

(22) Filed: Dec. 8, 2016

(65) Prior Publication Data

US 2017/0094426 A1 Mar. 30, 2017

Related U.S. Application Data

(63) Continuation-in-part of application No. 15/195,100, filed on Jun. 28, 2016, which is a continuation of application No. 14/032,310, filed on Sep. 20, 2013, now abandoned, which is a continuation of application No. 13/865,717, filed on Apr. 18, 2013, now Pat. No. 8,577,067, which is a continuation of application No. 12/841,120, filed on Jul. 21, 2010, now Pat. No. 8,457,337.

(60) Provisional application No. 61/228,571, filed on Jul. 25, 2009, provisional application No. 61/228,588,
(Continued)

(51) Int. Cl.
*H04R 25/00* (2006.01)
*H04R 1/10* (2006.01)

(52) U.S. Cl.
CPC ..... *H04R 25/556* (2013.01); *H04R 1/1058* (2013.01)

(58) Field of Classification Search
CPC ..... H04R 25/656; H04R 25/48; H04R 25/02; H04R 25/456; H04R 25/652; H04R 25/606; H04R 25/604; H04R 25/658; H04R 2225/023; H04R 1/42; H04R 2460/09; H04R 2460/11; H04R 2460/13; H04R 2460/17
See application file for complete search history.

(56) References Cited

U.S. PATENT DOCUMENTS 3,183,312 A 5/1965 Solomon et al.
5,031,219 A 7/1991 Ward et al.
5,259,032 A 11/1993 Perkins et al.
(Continued)

OTHER PUBLICATIONS

International Search Report for PCT/US2016/065676 dated Apr. 17, 2017.

*Primary Examiner* — Brian Ensey
(74) *Attorney, Agent, or Firm* — Law Office of Alan W. Cannon

(57) ABSTRACT

Securing mechanisms for space access devices, such as an audio signal transmitting device, include a plurality of outwardly projecting members that are configured to transition from a relaxed state to a securing state when the space access device is inserted into an internal space or opening that has an inside diameter smaller than an outside diameter of the outwardly projecting members in the relaxed state. The outwardly projecting members securely engage a surface of the internals space, conform to the shape and size of the internal space, and modulate at least one of the attenuation and frequency of audio signals and/or differentially acoustically impede audio signals transmitted through the securing mechanism and/or internal space and the space access device, without fully occluding the internal space.

44 Claims, 13 Drawing Sheets

Related U.S. Application Data filed on Jul. 26, 2009, provisional application No. 61/227,437, filed on Jul. 22, 2009.

(56) References Cited

U.S. PATENT DOCUMENTS 5,425,104 A 6/1995 Shennib
5,535,282 A 7/1996 Luca
5,572,594 A * 11/1996 Devoe ..... H04R 25/656 381/322
5,691,515 A 11/1997 Landis
5,881,159 A 3/1999 Aceti et al.
5,979,589 A 11/1999 Aceti
5,987,146 A * 11/1999 Pluvinage ..... H04R 25/652 381/328
6,033,417 A 3/2000 Tseng
6,058,198 A * 5/2000 Aceti ..... H04R 5/04 381/322
6,072,884 A 6/2000 Kates
6,137,889 A 10/2000 Shennib et al.
6,256,396 B1 7/2001 Cushman
6,473,513 B1 10/2002 Shennib et al.
6,879,695 B2 4/2005 Maltan et al.
6,940,989 B1 9/2005 Shennib et al.
7,076,076 B2 * 7/2006 Bauman ..... H04R 25/604 381/322
7,313,245 B1 12/2007 Shennib
7,362,875 B2 4/2008 Saxton et al.
7,421,086 B2 9/2008 Bauman et al.
7,480,387 B2 1/2009 Meyer et al.
7,580,537 B2 * 8/2009 Urso ..... H04R 25/652 381/322
7,627,131 B2 12/2009 Nielsen et al.
8,553,901 B2 10/2013 Hersbach
8,934,587 B2 1/2015 Weber
2002/0027996 A1 * 3/2002 Leedom ..... H04R 25/608 381/322
2004/0052391 A1 3/2004 Bren et al.
2005/0096678 A1 5/2005 Olson
2005/0244026 A1 11/2005 Nielsen et al.
2006/0085018 A1 4/2006 Clevenger
2007/0009106 A1 1/2007 Tilson et al.
2007/0100197 A1 5/2007 Perkins et al.
2008/0137892 A1 6/2008 Shennib et al.
2008/0253596 A1 10/2008 Klinkby et al.
2009/0041279 A1 2/2009 Davis
2009/0052709 A1 2/2009 Smith
2009/0052710 A1 2/2009 Smith
2009/0074220 A1 3/2009 Shennib et al.
2012/0296355 A1 11/2012 Burres
2014/0052163 A1 2/2014 Lai
2014/0219488 A1 8/2014 Michel et al.
2015/0063612 A1 3/2015 Petersen et al.
2015/0289064 A1 10/2015 Jensen et al.

* cited by examiner

ADJUSTABLE SECURING MECHANISM

CROSS-REFERENCE

This application is a continuation-in-part application of co-pending U.S. application Ser. No. 15/195,100, filed Jun. 28, 2016, which is a continuation of U.S. application Ser. No. 14/032,310, filed Sep. 20, 2013, which is a continuation of U.S. application Ser. No. 13/865,717, filed Apr. 18, 2013, now U.S. Pat. No. 8,577,067, which is a continuation of U.S. application Ser. No. 12/841,120, filed Jul. 21, 2010, now U.S. Pat. No. 8,457,337, which claims the benefit of U.S. Provisional Application No. 61/228,571, filed Jul. 27, 2009 and claims the benefit of U.S. Provisional Application No. 61/228,588, filed Jul. 26, 2009, each of which applications and patents now being incorporated herein, in its entirety, by reference thereto and to which non-provisional applications we claim priority under 35 USC §120 and to which provisional applications we claim priority under 35 USC §119.

This application claims the benefit of U.S. Provisional Application No. 62/246,583, filed on Dec. 8, 2015, which application is hereby incorporated herein, in its entirety, by reference thereto, and to which we claim priority under 35 U.S.C. Section 119.

This application also hereby incorporates U.S. application Ser. No. 15/373,389, filed on even date herewith and titled "Apparatus, System and Method for Reducing Feedback Interference Signals" in its entirety, by reference thereto.

BACKGROUND OF THE INVENTION

As is well known in the art, many space access devices and systems are designed and configured to be inserted in one or more biological spaces or openings, such as an ear canal, nasal opening, etc. Such devices include hearing aids, ear phones or buds, and oxygen nasal cannula.

Various space access devices and systems are also designed and configured to be inserted in non-biological spaces or openings, such a fluid flow lines and conduits. Such devices include conduit inspection and energy, e.g. heat, generating and/or dissipating systems.

The noted devices and systems often include means of securing the devices and/or systems in internal spaces or openings for a desired period of time, e.g. 1-2 minutes, 24 hours, 1 month, 1 year, etc. Such securing means include, for example, securing rings disposed on the outer surface of the devices, compliant outer layers, and/or conical fins that are adapted to removably secure the device(s) to an interior surface of a space or opening, e.g., an ear canal.

There are, however, a number of significant drawbacks and disadvantages associated with conventional securing means; particularly when employed on audio transmitting (or receiving) devices, such as an in-ear hearing device.

A major disadvantage of conventional securing means is that the securing means, e.g., securing rings and compliant outer surfaces, do not include any means for fluid flow through the device or between the device and the internal space or opening when the device is inserted therein.

Another drawback is that most of the devices employing the conventional securing means are easily dislodged.

A further drawback is that most conventional securing means do not self-adjust or self-conform to the shape of the internal space or opening when the space access device is inserted therein. Indeed, many conventional securing devices either have a preset circular shape that may conform adequately to the shape of an internal space or opening, or are custom made to conform to (or match) the shape of a space or opening.

A further drawback is that most of the conventional securing means do not include any means for adjusting the force applied to the surface of the space or opening to secure the device therein. Indeed, except for the securing means disclosed in Applicants' U.S. Pat. Nos. 8,457,337; 8,577,067 and 9,167,363, and co-pending application Ser. Nos. 15/195,100 and 14/032,310, virtually all known securing devices are designed and adapted to apply a predetermined narrow range of force to an internal space or opening when a space access device employing the securing means is inserted therein.

An additional drawback is that most of the conventional securing means do not include any means for modulating the amplitude and/or frequency of audio signal transmitted through the securing means and/or space access device associated therewith and/or the space between the surface of an internal space or opening and the space access device, when the space access device is inserted therein.

It would thus be desirable to provide securing means for space access devices; particularly, audio transmitting devices, that (i) securely engage a surface of an internal space or opening for an extended period of time, (ii) include means to conform or self-adjust to the shape of an internal space or opening, (iii) include means for adjusting the force applied to a surface of an internal space or opening, (iv) include means for fluid flow through the device and/or between the device and a space or opening when the device is inserted therein and/or (v) include means for modulating the amplitude and/or frequency of audio signals transmitted through the securing means and/or space access device associated therewith and/or the space between the surface of an internal space or opening and the space access device, when the devices are inserted in the internal space or opening, e.g., ear canal.

It would be desirable to provide improved securing means for space access devices; particularly, audio transmitting devices, that (i) securely engage a surface of an internal space or opening for an extended period of time, (ii) include means to conform or self-adjust to the shape of an internal space or opening, (iii) include means for adjusting the force applied to a surface of an internal space or opening, (iv) include means for fluid flow through the device and/or between the device and a space or opening when the device is inserted therein and/or (v) include means for modulating the amplitude and/or frequency of audio signals transmitted through the securing means and/or space access device associated therewith and/or the space between the surface of an internal space or opening and the space access device, when the devices are inserted in the internal space or opening.

It would further be desirable to provide space access devices; particularly, audio transmitting devices, that (i) securely engage a surface of an internal space or opening for an extended period of time, (ii) include means to conform or self-adjust to the shape of an internal space or opening, (iii) include means for adjusting the force applied to a surface of an internal space or opening, (iv) include means for fluid flow through the device and/or between the device and a space or opening when the device is inserted therein and/or (v) include means for modulating the amplitude and/or frequency of audio signals transmitted through the securing means and/or space access device associated therewith and/or the space between the surface of an internal space or opening and the space access device, when the devices are inserted in the internal space or opening.

SUMMARY OF THE INVENTION

The present invention is directed to securing mechanisms that can be readily employed with devices and systems that are configured to be inserted in one or more biological spaces or openings, such as ear canals or non-biological spaces or openings.

According to an aspect of the present invention, a securing mechanism for an audio signal transmitting device is provided that includes: a base comprising a longitudinal axis and an outer surface; and an adjustable securing mechanism disposed on at least a portion of the base, the securing mechanism being configured to contact a surface of an internal space or opening into which the securing mechanism is inserted; the adjustable securing mechanism being configured for positioning and maintaining the base at a distance from a location along the internal space or opening; and wherein a least a portion of the adjustable securing mechanism being configured to transition from a first state to a securing state when inserted into the internal space or opening, the securing state comprising at least a portion of the adjustable securing mechanism being constrained to have a smaller cross-sectional diameter relative to a cross-sectional diameter in the first state.

In at least one embodiment, the adjustable securing mechanism comprises a plurality of members, at least some of the members comprising at least one of: bristles, protrusions, ridges, grooves, blades, bubbles, hooks and tubes.

In at least one embodiment, the adjustable securing mechanism is configured to allow external sound to be transmitted therepast when the securing mechanism is secured in the internal space or opening.

In at least one embodiment, the securing mechanism is installed on an in-the-ear hearing aid.

In at least one embodiment, the securing mechanism is installed on an earpiece speaker.

In at least one embodiment, the adjustable securing mechanism is configured to self-adjust to a shape and/or size of the internal space or opening when the securing mechanism is secured in the internal space or opening.

In at least one embodiment, the adjustable securing mechanism is configured to conform to a shape and/or size of the internal space or opening when the securing mechanism is secured in the internal space or opening.

In at least one embodiment, the adjustable securing mechanism is configured to modulate at least one of an amplitude and a frequency of audio signals transmitted through the internal space or opening when the securing means is secured in the internal space or opening.

In at least one embodiment, the adjustable securing mechanism provides differential acoustic impedance when used in conjunction with the audio signal transmitting device and inserted in the internal space or opening.

In another aspect of the present invention, a kit is provided that includes a plurality of securing mechanisms for an audio signal transmitting device, each securing mechanism comprising: a base comprising a longitudinal axis and an outer surface; and an adjustable securing mechanism disposed on at least a portion of the base, the securing mechanism being configured to contact a surface of an internal space or opening into which the securing mechanism is inserted; wherein each of the adjustable securing mechanisms is configured to perform at least one of: differential acoustic impedance of; modulation of an amplitude of, or modulation of a frequency of audio signals transmitted through the internal space or opening when the securing mechanism is secured in the internal space or opening; and wherein an amount of the at least one of differential acoustic impedance, modulation of amplitude and/or modulation of frequency of audio signals provided by each securing mechanism is different from an amount of the at least one of differential acoustic impedance, modulation of amplitude and/or modulation of frequency of audio signals by each of the others of the securing mechanisms.

In at least one embodiment, at least a portion of each adjustable securing mechanism is configured to transition from a first state to a securing state when inserted into the internal space or opening, the securing state comprising at least a portion of the adjustable securing mechanism being constrained to have a smaller cross-sectional diameter relative to a cross-sectional diameter in the first state.

In at least one embodiment, each of the adjustable securing mechanisms comprises a plurality of outwardly projecting members projecting outwardly from the base and gaps formed between the outwardly projecting members, wherein at least one of a width of the gaps and a width of the outwardly projecting members in a first one of the adjustable securing mechanisms is different from a respective width of the gaps or width of the outwardly projecting members of another of the adjustable securing members.

In at least one embodiment, each of the adjustable securing mechanisms comprises a plurality of outwardly projecting members arranged in rows and projecting outwardly from the base, wherein a distance between the rows of a first adjustable securing mechanism is different from a distance between the rows of a second adjustable securing mechanism, wherein the distances are measured in a direction along a longitudinal axis of the securing mechanisms.

In at least one embodiment, each of the adjustable securing mechanisms comprises a plurality of outwardly projecting members arranged in rows, with the outwardly projecting members in at least one of the rows being separated by gaps; and wherein a first amount of overlap of the gaps in at least one of the rows, by outwardly projecting members in a row immediately adjacent the at least one of the rows in a first one of the adjustable securing mechanisms is different from a second amount of overlap of the gaps in the at least one of the rows, by outwardly projecting members in a row immediately adjacent the at least one of the rows in another one of the adjustable securing mechanisms.

In at least one embodiment, each of the adjustable securing mechanisms comprises a plurality of outwardly projecting members arranged in rows; wherein the outwardly projecting members comprise a length and a width; wherein gaps separate the outwardly projecting members; wherein the rows are separated by a row distance measured in a direction along a longitudinal axis of the securing mechanisms; wherein the gaps comprise a maximum gap width; wherein the gaps comprise a gap angle; wherein the outwardly projecting members are angled with respect to a normal to the longitudinal axis; wherein the gaps in a first row are overlapped by outwardly projecting members of an immediately adjacent row by a value in a range from 0% to 100% in a direction aligned with the longitudinal axis; and wherein a set including the characteristics of the length of the outwardly projecting member, width of the outwardly projecting member, row distance, maximum gap width of the gaps, gap angle, angle of the outwardly projecting members with respect to a normal to the longitudinal axis, and overlap of the gaps for each the adjustable securing mechanism, is selected to be different from sets including the characteristics of the length of the outwardly projecting member, width of the outwardly projecting member, row distance, maximum gap width of the gaps, gap angle, angle of the outwardly projecting members with respect to a normal to the longitudinal axis, and overlap of the gaps for all other of the adjustable securing mechanisms.

In another aspect of the present invention, a securing mechanism for an audio signal transmitting device is provided that includes: a base comprising a longitudinal axis and an outer surface; and an adjustable securing mechanism disposed on at least a portion of the base, the securing mechanism being configured to contact a surface of an internal space or opening into which the securing mechanism is inserted; wherein the adjustable securing mechanism comprises rows each comprising a plurality of outwardly projecting members separated by gaps, wherein the gaps in a first of the rows are overlapped by the outwardly projecting members of an immediately adjacent row by an amount greater than 50% of the gap, in a direction aligned with the longitudinal axis.

In at least one embodiment, the gaps in the first row are overlapped 100% by the outwardly projecting members of the immediately adjacent row.

In at least one embodiment, the securing mechanism is installed on an in-the-ear hearing aid.

In at least one embodiment, the securing mechanism is installed on an earpiece speaker.

In at least one embodiment, the adjustable securing mechanism is configured to perform at least one of: differential acoustic impedance of; modulation of an amplitude of, or modulation of a frequency of audio signals transmitted through the internal space or opening when the securing means is secured in the internal space or opening.

In another aspect of the present invention, an audio signal transmitting device includes: a base member including at least one electronic component configured to transmit an audio signal; and an adjustable securing mechanism disposed on at least a portion of the base, the securing mechanism being configured to contact a surface of an internal space or opening into which the securing mechanism is inserted; wherein the adjustable securing mechanism comprises rows each comprising a plurality of outwardly projecting members separated by gaps, wherein the gaps in a first of the rows are overlapped by the outwardly projecting members of an immediately adjacent row by an amount greater than 50% of the gap, in a direction aligned with the longitudinal axis.

In at least one embodiment, the gaps in the first row are overlapped 100% by the outwardly projecting members of the immediately adjacent row.

In at least one embodiment, the base member comprises an in-the-ear hearing aid.

In at least one embodiment, the base member comprises an earpiece speaker.

In at least one embodiment, the adjustable securing mechanism is removably attachable to the base member.

In at least one embodiment, the adjustable securing mechanism is permanently attached to the base member.

In at least one embodiment, the adjustable securing mechanism is integral with the base member.

In another aspect of the present invention, a method of changing at least one of characteristics of an audio signal transmitting device when inserted into an internal space or opening, wherein the characteristics include: differential acoustic impedance of the audio signals, modulation of an amplitude of the audio signals, or modulation of frequency of the audio signals transmitted through the internal space or opening when the securing means is secured in the internal space or opening includes: providing the audio signal transmitting device with a first securing mechanism attached thereto and configured to contact a surface of an internal space or opening into which the securing mechanism is inserted, wherein the first securing mechanism is configured to perform at least one of: a first differential acoustic impedance of; a first modulation of an amplitude of, or a first modulation of a frequency of audio signals transmitted through the internal space or opening when the audio transmitting device and first securing mechanism are secured in the internal space or opening; removing the first securing mechanism from the audio signal transmitting device; and attaching a second securing mechanism to the audio signal transmitting device, wherein the second securing mechanism is configured to perform at least one of: a second differential acoustic impedance of; a second modulation of an amplitude of, or a second modulation of a frequency of audio signals transmitted through the internal space or opening when the audio transmitting device and securing mechanism are secured in the internal space or opening; and wherein at least one of the second differential acoustic impedance of; second modulation of an amplitude of, or second modulation of a frequency of audio signals transmitted through the internal space or opening when the audio transmitting device and second securing mechanism are secured in the internal space or opening is different from the first differential acoustic impedance of; first modulation of an amplitude of, or first modulation of a frequency of audio signals transmitted through the internal space or opening when the audio transmitting device and first securing mechanism are secured in the internal space or opening.

In at least one embodiment, each of the first and second securing mechanisms comprises a plurality of outwardly projecting members arranged in rows; wherein the outwardly projecting members comprise a length and a width; wherein gaps separate the outwardly projecting members; wherein the rows are separated by a row distance measured in a direction along a longitudinal axis of the securing mechanisms; wherein the gaps comprise a maximum gap width; wherein the gaps comprise a gap angle; wherein the outwardly projecting members are angled with respect to a normal to the longitudinal axis; wherein the gaps in a first row are overlapped by outwardly projecting members of an immediately adjacent row by a value in a range from 0% to 100% in a direction aligned with the longitudinal axis; and wherein a set including the characteristics of the length of the outwardly projecting member, width of the outwardly projecting member, row distance, maximum gap width of the gaps, gap angle, angle of the outwardly projecting members with respect to a normal to the longitudinal axis, and overlap of the gaps for the first securing mechanism, is selected to be different from a set including the characteristics of the length of the outwardly projecting member, width of the outwardly projecting member, row distance, maximum gap width of the gaps, gap angle, angle of the outwardly projecting members with respect to a normal to the longitudinal axis, and overlap of the gaps for the second securing mechanism.

In at least one embodiment each overlap of one of the first and second securing mechanisms is 100%.

In another aspect of the present invention, a securing mechanism for an audio signal transmitting device includes: a base comprising a longitudinal axis and an outer surface; a plurality of outwardly projecting members; at least a portion of the plurality of outwardly projecting members extending outwardly form the base at a non-zero angle relative to a normal to a longitudinal axis to the base; wherein at least a portion of the outwardly projecting members are configured to transition from a first state to a securing state when inserted in an internal space and modulate at least one of frequency of audio signals and amplitude of audio signals pass through the plurality of outwardly projecting members.

In at least one embodiment, the outwardly projecting bristle members each comprise a length in the range of about 0.1 μm to about 3 cm and a width in the range of about 1.0 μm to about 20 cm. In another preferred embodiment, maximum length is about 2 cm and maximum length is about 2 cm For the ear, max conceivable would be: 2 cm in length and 2 cm in width In at least one embodiment, the modulation occurs in a frequency range of about 10 to 100 kHz.

In at least one embodiment, modulation of amplitude is in a range of about 0.1 dB to about 150 dB.

In at least one embodiment, the plurality of outwardly projecting members are in the securing state, the outwardly projecting members are configured to apply a pressure to a surface of the internal space in a range of about 0.1 kPa to about 10 kPa.

In at least one embodiment, the outwardly projecting members have an open area less than about 5% when the outwardly projecting members are in the securing state.

In at least one embodiment, the outwardly projecting members have an open area less than about 5% when the securing mechanism performs the at least one modulate function.

In at least one embodiment, at least a portion of the plurality of outwardly projecting members comprise triangular-shaped gaps therebetween, each the triangular-shaped gap comprising a depth in the range of about 5% to about 95% of a length of the outwardly projecting members; and wherein each the triangular-shaped gap comprises a gap angle in a range of about 0.5 degrees to about 180 degrees.

In at least one embodiment, at least a portion of the plurality of outwardly projecting members comprises an outer coating comprising a pharmacological composition.

In at least one embodiment, the pharmacological composition comprises an anti-inflammatory agent.

These and other advantages and features of the invention will become apparent to those persons skilled in the art upon reading the details of the invention as more fully described below.

BRIEF DESCRIPTION OF THE DRAWINGS

In the course of the detailed description to follow, reference will be made to the attached drawings. These drawings show different aspects of the present invention and, where appropriate, reference numerals illustrating like structures, components, materials and/or elements in different figures are labeled similarly. It is understood that various combinations of the structures, components, materials and/or elements, other than those specifically shown, are contemplated and are within the scope of the present invention.

FIG. 5 is a front view of the securing mechanism shown in FIG. 4, i.e., in the constrained configuration referred to.

DETAILED DESCRIPTION OF THE INVENTION

Figure 1A:
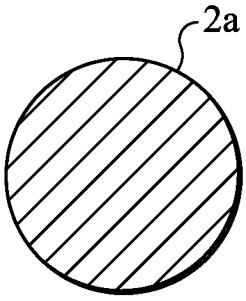
FIGS. 1A-1F cross-sectional sectional views of several embodiments of cross-sectional shapes of securing mechanism bristles, according to an aspect of the present invention.

Before the present systems, devices, mechanisms and methods are described, it is to be understood that this invention is not limited to particular embodiments described, as such may, of course, vary. It is also to be understood that the terminology used herein is for the purpose of describing particular embodiments only, and is not intended to be limiting, since the scope of the present invention will be limited only by the appended claims.

It is also to be understood that, although the securing mechanism structures and systems of the invention are illustrated and described in connection with in-ear hearing devices, the securing mechanism structures and systems of the invention are not limited to in-ear hearing devices and systems. According to the invention, the securing mechanism structures and systems of the invention can be employed on any anatomical, i.e. biological, space access device or system, e.g. an in-ear head set, and non-biological space access device or system, e.g., inspection systems for fluid flow pipes and/or conduits, etc.

It is also to be understood that the terminology used herein is for the purpose of describing particular embodiments of the invention only and is not intended to be limiting.

Unless defined otherwise, all technical and scientific terms used herein have the same meaning as commonly understood by one having ordinary skill in the art to which the invention pertains.

Further, all publications, patents and patent applications cited herein, whether supra or infra, are hereby incorporated by reference in their entirety.

Where a range of values is provided, it is understood that each intervening value, to the tenth of the unit of the lower limit unless the context clearly dictates otherwise, between the upper and lower limits of that range is also specifically disclosed. Each smaller range between any stated value or intervening value in a stated range and any other stated or intervening value in that stated range is encompassed within the invention. The upper and lower limits of these smaller ranges may independently be included or excluded in the range, and each range where either, neither or both limits are included in the smaller ranges is also encompassed within the invention, subject to any specifically excluded limit in the stated range. Where the stated range includes one or both of the limits, ranges excluding either or both of those included limits are also included in the invention.

Although any methods and materials similar or equivalent to those described herein can be used in the practice or testing of the present invention, the preferred methods and materials are now described.

It must be noted that as used herein and in the appended claims, the singular forms "a", "an", and "the" include plural referents unless the context clearly dictates otherwise. Thus, for example, reference to "a member" includes a plurality of such members and reference to "the bristle" includes reference to one or more bristles and equivalents thereof known to those skilled in the art, and so forth.

The publications discussed herein are provided solely for their disclosure prior to the filing date of the present application. The dates of publication provided may be different from the actual publication dates which may need to be independently confirmed.

Definitions

The term "outwardly projecting member", as used in connection with a securing mechanism of the invention, means and includes any projection extending from a base member, including, without limitation, fins, bristles, blades, protrusions, ridges, grooves, bubbles, balloons, hooks, looped structure, disks and/or tubes.

The term "space access device", as used herein, means and includes audio signal transmitting devices, including but not limited to anatomical or biological and non-biological devices that are designed and adapted to be inserted into a space or opening, such as an ear canal, nasal conduit, esophagus, airway, gastro-intestinal tract, blood vessel, pipe, or conduit.

The terms "frequency modulation", "modulate a frequency" and the like, as used herein, mean and include modulation of the frequency of a transmitted audio signal. Thus, "frequency modulation" or "modulate a frequency", as used in connection with a securing mechanism of the invention, means and includes modulating the frequency of an audio signal that is transmitted from an external source, wherein the audio signal has a first frequency at a first external reference point and, after transmission through a securing mechanism of the invention, has an adjusted second frequency at a second reference point, wherein the adjusted second frequency is unequal to the first frequency.

The terms "amplitude modulation", "modulate an amplitude" and the like, as used herein, mean and include modulation of the amplitude of a transmitted audio signal. Thus, "amplitude modulation" or "modulate an amplitude", as used in connection with a securing mechanism of the invention, means and includes modulating the amplitude of an audio signal that is transmitted from an external source, wherein the audio signal has a first amplitude at a first external reference point and, after transmission through a securing mechanism of the invention, has an adjusted second amplitude at a second reference point, wherein the adjusted second amplitude is unequal to the first amplitude.

The terms "headphone" and "headset" are used interchangeably herein and mean and include a listening device that is adapted to receive transmitted sound via wireless or wired communication means. As is well known in the art, conventional headphones and headsets typically include one or more speakers and/or sound production components, which can be in the form of one or two earpieces (often referred to as "ear plugs" or "ear buds").

The term "differential acoustic impedance" as used herein, means and includes a property, configuration or function that causes different wavelengths of an audio signal to be differentially impeded. Typically, for the embodiments describe herein the devices and/or securing mechanisms, when providing differential acoustic impedance impeded the high frequencies of the signal to a greater extent than the degree to which mid and low range frequencies are impeded. Optionally, mid-range frequencies may be impeded more than the low range frequencies, but still less than the high range frequencies. Approximate dividing lines between the different ranges referred to are: high range: 2 kHz and above; midrange: 500 Hz to 2 kHz; and low range: below 500 Hz.

The terms "pharmacological agent", "active agent", "drug" and "active agent formulation" are used interchangeably herein, an mean and include an agent, drug, compound, composition of matter or mixture thereof, including its formulation, which provides some therapeutic, often beneficial, effect. This includes any physiologically or pharmacologically active substance that produces a localized or systemic effect or effects in animals, including warm blooded mammals, humans and primates, avians, domestic household or farm animals, such as cats, dogs, sheep, goats, cattle, horses and pigs; laboratory animals, such as mice, rats and guinea pigs; reptiles, zoo and wild animals, and the like.

The terms "pharmacological agent", "active agent", "drug" and "active agent formulation" thus mean and include, without limitation, antibiotics, anti-viral agents, analgesics, steroidal anti-inflammatories, non-steroidal anti-inflammatories, anti-neoplastics, anti-spasmodics, modulators of cell-extracellular matrix interactions, proteins, hormones, enzymes and enzyme inhibitors, anticoagulants and/or antithrombotic agents, DNA, RNA, modified DNA and RNA, NSAIDs, inhibitors of DNA, RNA or protein synthesis, polypeptides, oligonucleotides, polynucleotides, nucleoproteins, compounds modulating cell migration, compounds modulating proliferation and growth of tissue, and vasodilating agents.

The following disclosure is provided to further explain in an enabling fashion the best modes of performing one or more embodiments of the present invention. The disclosure is further offered to enhance an understanding and appreciation for the inventive principles and advantages thereof, rather than to limit in any manner the invention. The invention is defined solely by the appended claims including any amendments made during the pendency of this application and all equivalents of those claims as issued.

As will readily be appreciated by one having ordinary skill in the art, the present invention substantially reduces or eliminates the disadvantages and drawbacks associated with conventional securing means for space access devices.

In overview, one aspect of the present invention is directed to securing mechanisms that can be readily employed with devices and systems that are configured to be inserted in one or more biological spaces or openings, such as an ear canal.

As discussed in detail below, according to an aspect of the invention, the securing mechanisms may include at least one, more preferably, a plurality of outwardly projecting members (e.g., bristle members) that are configured to transition from a relaxed state to a securing state when a space access device employing such a securing mechanism is disposed in an internal space or opening, wherein the bristle members and, hence securing mechanisms (i) securely engage a surface of the internal space or opening, (ii) conform to the shape and size of an internal space or opening, and (iii) modulate pressure waves or audio signals through the securing member and, hence, space access device, and between the device and the internal space or opening, thereby modulating the amplitude and/or frequency of the pressure waves or audio signals transmitted through the securing member and/or the space between the internal space or opening and the space access device, preferably without fully occluding the internal space or opening.

Figure 1B:
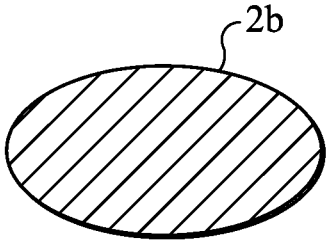
Figure 1C:
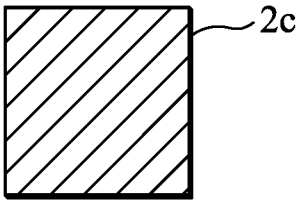
Figure 1D:
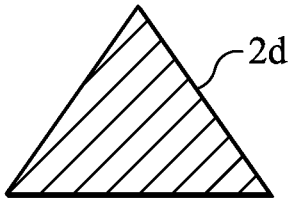
Figure 1E:
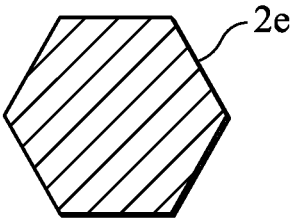
Figure 1F:
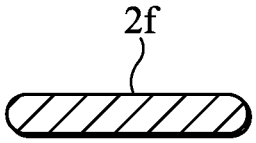

As illustrated in FIGS. 1A through 1F, according to an aspect of the invention, the members may comprise various cross-sectional shapes, including, but not limited to cylindrical 2*a*, as shown in FIG. 1A, elliptical 2*b*, as shown in FIG. 1B, square 2*c*, as shown in FIG. 1C, triangular 2*d*, as shown in FIG. 1D, hexagonal 2*e*, as shown in FIG. 1E or flat 2*f*, as shown in FIG. 1F. It is noted that the members, including bristle members and other types of members are not limited to these cross-sectional shapes, as the cross-sectional shape may be irregular, flat but v-shaped (i.e. two flat segments joining), flat with a circular or partially circular component, or other shape. For example, the bristle members 40 in FIGS. 15-22 have a cross-section shape that is partially flat and partially V-shaped, with a circular portion intervening, as can be discerned from the end view thereof in FIG. 17.

According to the invention, the space access devices of the invention, e.g., 10*a*, 10*b*,10*c* and/or 10*d* can comprise any device that is designed to be inserted into a biological space or opening, such as an ear canal, nasal opening, etc. (see, for example, FIG. 14).

In some embodiments of the invention, the space access device includes an electronics-containing portion or region 14 (see, e.g., FIG. 2) that is adapted to receive various electronic components and associated circuitry, such as sensor systems, receivers, amplifiers, batteries, antennae, speakers, energy generating and dissipating means, microphones, sensors, communication modules, pressure sensors, wireless communication components, wired communication components, etc.

The space access devices of the invention can thus comprise various conventional anatomical and non-anatomical devices and systems, such as physiological sensors, conduit inspection systems, flow sensors, flow restrictors, fluid samplers, pressure sensors, sound or vibration actuators, accelerometers, and mechanisms for releasing particles or fluids into conduits or other fluids, etc. The space access devices can also comprise a radio system or component thereof, e.g., receiver, transmitter, transceiver, microphone, microcontroller, etc.

Figure 2:
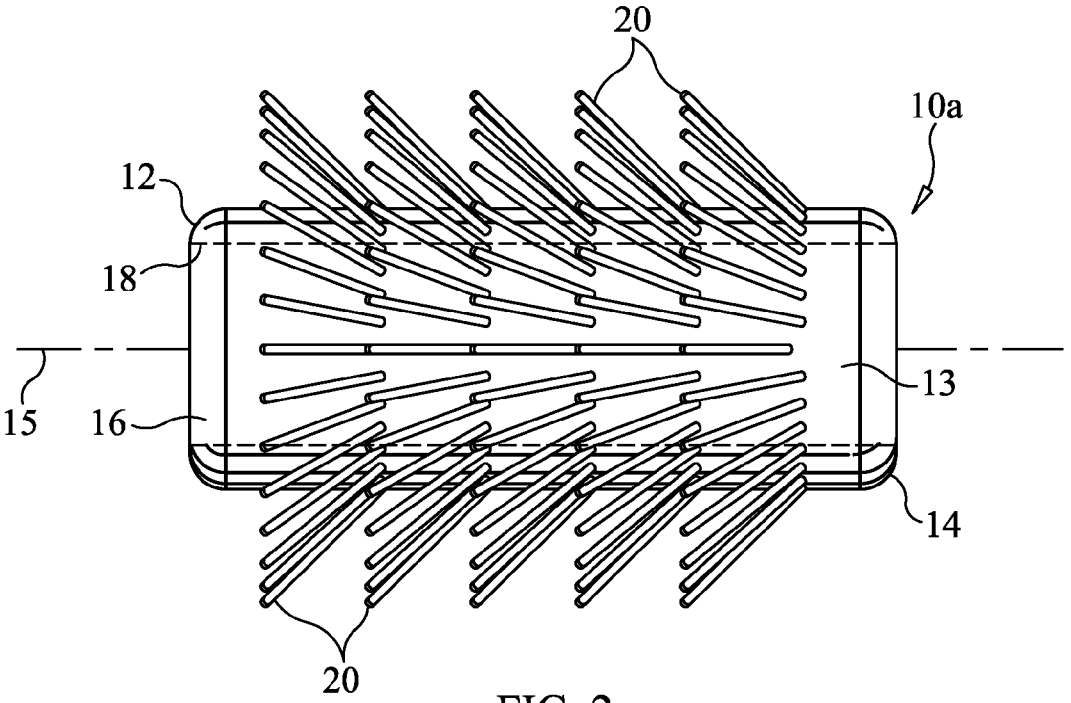
FIG. 2 is a side view of a securing mechanism, according to an embodiment of the present invention.
Figure 10:
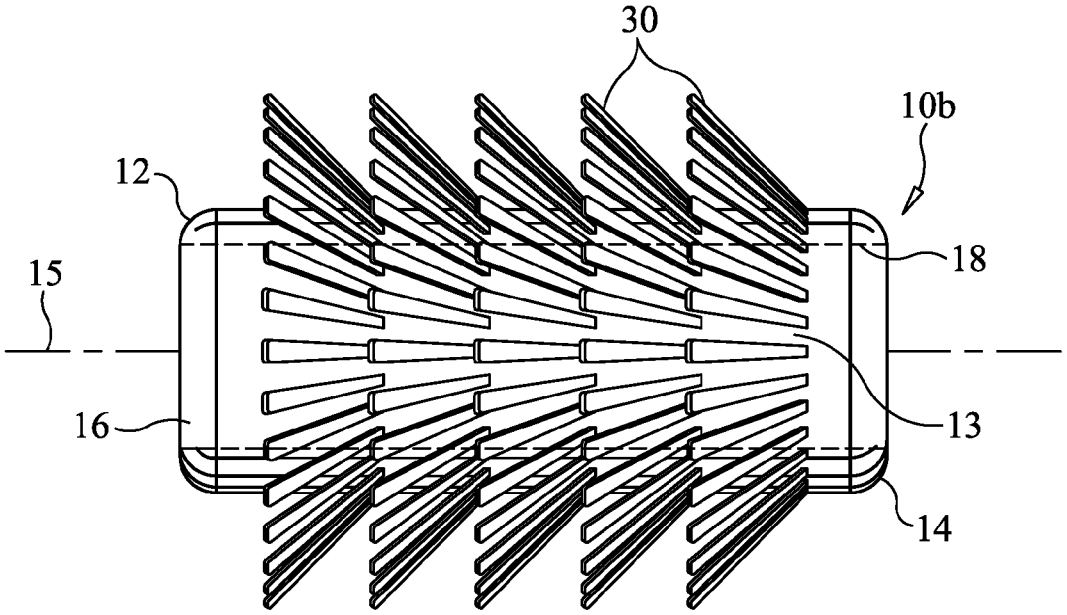
FIG. 10 is a side view of another embodiment of a securing mechanism, according to an aspect of the present invention.
Figure 11:
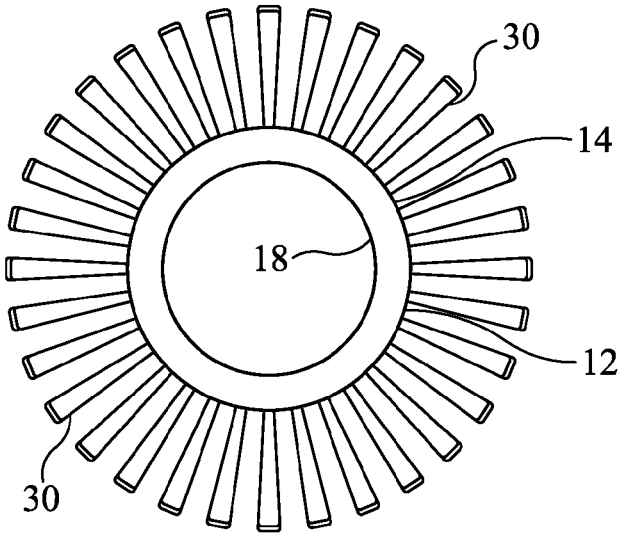
FIG. 11 is a front view of the securing mechanism shown in FIG. 10.
Figure 12:
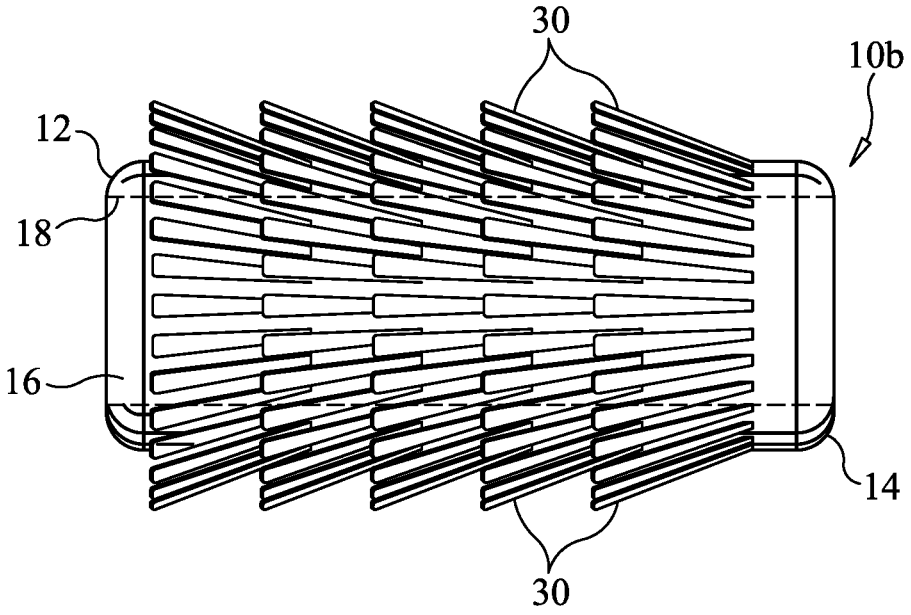
FIG. 12 is a side view of the securing mechanism shown in FIG. 10, but in a constrained configuration, according to an aspect of the present invention.
Figure 13:
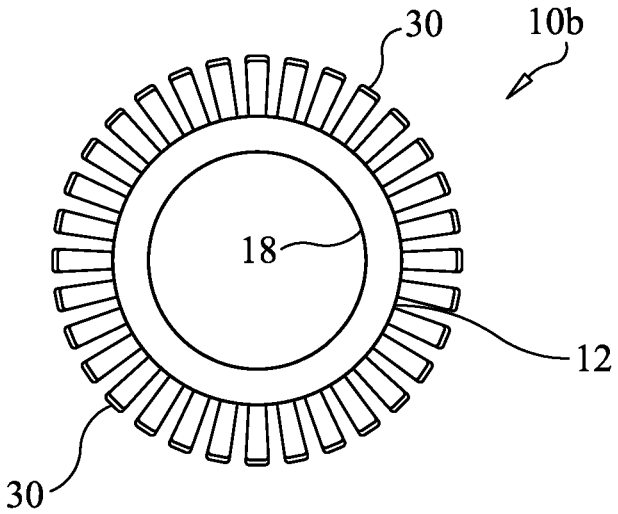
FIG. 13 is a front view of the securing mechanism in a constrained configuration shown in FIG. 12.

According to an aspect of the invention, the outwardly projecting members, such as bristle members can comprise separate members, i.e., engaged to a base member, or integral member that are integral with the base member and project outwardly from the base member as illustrated in FIGS. 2 and 10 by bristles 20 and 30, respectively, relative to base member 16.

As set forth in detail in U.S. Pat. No. 8,457,337 to which the present application claims priority and which is expressly incorporated by reference herein in its entirety, the space access devices can also comprise a hearing apparatus, such as a hearing prosthesis or aid.

Figure 22:
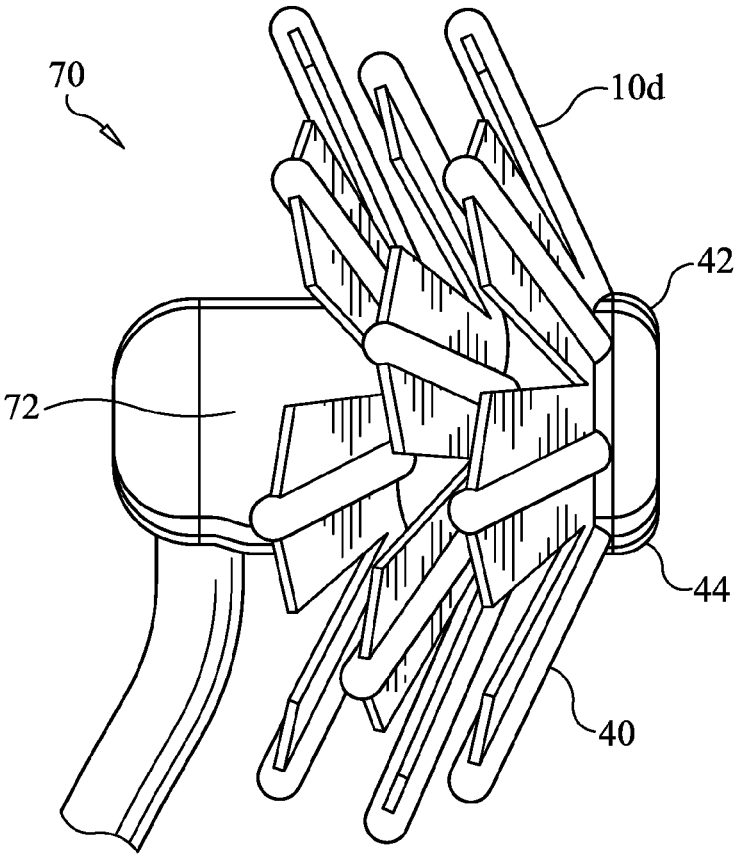
FIG. 22 is a side view of an earpiece speaker system having the securing mechanism shown in FIG. 15 disposed on the earpiece speaker system, according to an aspect of the present invention.

The space access devices can additionally comprise headphones or a headset for a portable electronic device, such as a GPS device, CD or DVD player, MPEG player, MP-3 player, cell phone, personal digital assistant (PDA), tablet, laptop, video game system, audio guide system, phone, musical instrument, stethoscope and other medical or industrial instrumentation, smart phone, computer, etc., and/or a combination thereof. FIG. 22 shows an embodiment according to the present invention wherein the space access device 70 comprises securing mechanism 10*d* attached to headphones or headset 72. Only one headphone 72 is shown, for simplicity of illustration, but typically a pair of such headphones 72 would be provided, each with a securing mechanism 10*d* attached or attachable thereto. In the embodiment shown in FIG. 22, the securing mechanism is removably attached to the headphone 72, but alternatively may be permanently attached thereto or integral therewith. Further alternatively, any of the other securing mechanisms 10*a*, 10*b*, 10*c* described herein may be similarly attached to headphones 72 in any of the same manners.

The space access devices can also comprise headphones (or a headset) for augmented reality glasses, head-mounted displays, and/or heads-up displays.

There are a wide variety of headset types, including over-ear headsets, around-ear headsets, on ear headsets, in-concha headsets, in-ear headsets, etc. Each type of head set has advantages and disadvantages with regard to sound quality, ease of use, aesthetics, user comfort, etc.

Two popular headset designs are the in-concha headset and the in-ear headset. The in-concha headset design generally includes a speaker that is, when properly positioned, received within the concha of the ear of a user (generally the area of the ear surrounding the opening of the ear canal). The in-ear headset design generally includes a speaker and/or insert that is at least partially received within the ear canal of a user when properly positioned. These designs are typically compact and are often supported by a small structure that is secured to the external portion of the ear (e.g., with an ear hook) and/or supported and/or retained within the ear by the concha or ear canal in what amounts to an interference fit.

A major drawback of both the in-concha and in-ear headsets is that wearers often experience discomfort after a period of time of use. The discomfort can be due to one or more of the fitment or breathability of the headset, the type of material of which the headset is composed, the pressure of the headset on the surface of the ear canal, or simply sensitive ears.

A further drawback of in-concha and in-ear headsets is that they are also easily dislodged during various activities of the wearer, e.g., jogging.

A further drawback of in-concha and in-ear headsets is that they often fail at maintaining a good alignment between the speaker and the ear canal, which may result in inconsistent sound quality and/or sound volume.

A further drawback of in-concha and in-ear headsets is that they often limit the amount of ambient sound that enters the ear canal, which can reduce the wearer's environmental awareness and ability to interact with the environment and others in the environment.

Another drawback is that some headsets require components that need to be molded for a specific user to achieve the desired fit.

By employing a securing mechanism of the invention with in-concha and in-ear headsets the noted discomfort can, however, be substantially reduced or eliminated. The securing mechanism will also enhance the engagement and hold of the head set in the concha or ear canal(s). The securing mechanism will also enhance the alignment of the headset with the ear canal(s). The securing mechanism will also enhance the ability to hear ambient sounds.

Figure 3:
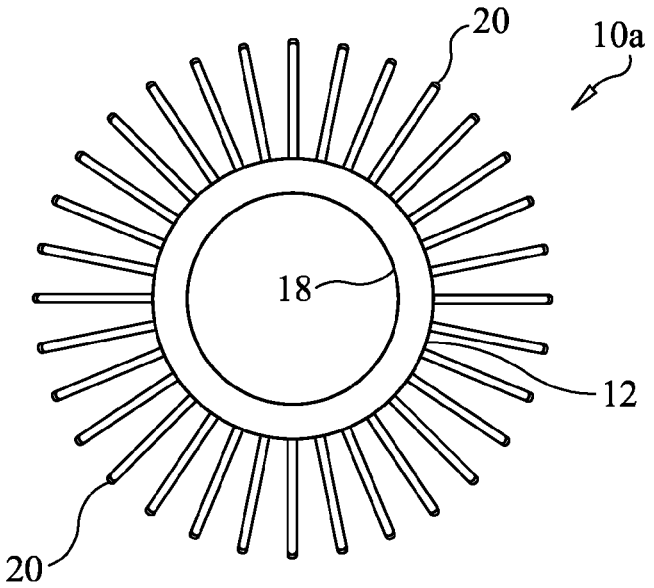
FIG. 3 is a front view of the securing mechanism shown in FIG. 2.

FIG. 2 shows a side view and FIG. 3 shows an end view (viewed at the distal end 18) of a securing mechanism 10*a*, according to an embodiment of the present invention. The securing mechanism 10*a*, as noted above may be used to secure any space access device including, but not limited to hearing aids, speaker systems, other biological, space access devices or systems, and non-biological space access device or system, e.g., inspection systems for fluid flow pipes and/or conduits, etc.

One or more of the parts described may be integrated into one component or integrally connected. For example, a securing part may be integrally formed with a base member or housing. They may be connected as an integral piece or separate portions.

The base 16 of the securing mechanism may have a cylindrical shape, as illustrated in FIGS. 2-3, with a lumen 18 (in this example, an annulus, since the cross-section of the lumen 18 is circular in this embodiment) configured and dimensioned to allow the securing mechanism 10*a* to be slid over and attached to a portion of the body of a space access device. For example, the space access device 10 of FIG. 6 has a cylindrically-shaped body portion 64 that is configured and dimensioned to receive securing mechanism 20*a* slidably thereover. A lip 64L is provided on an end portion of the body portion 64 that has an outside diameter, in an un-deformed state, that is greater than an inside diameter of the lumen 18 in an un-deformed state. In a preferred embodiment, lip 64L is made of a resiliently compressible material (such as silicone or other elastomer) that allows it to be compressed to a smaller outside diameter as the securing mechanism 10*a* is slid thereover. Typically, the securing mechanism 18 would be passed over the lip 64L and portion 64 starting from end 12 and ending at end 14. Once end 14 passes over and clears lip 64L, lip 64L resiliently expands to its un-deformed condition, thereby securing the securing mechanism 10*a* on the body portion 64, not to be removed without a substantial pulling force being applied thereto, wherein the substantial pulling force is at least two times greater or three times greater or four times greater or more than four times greater than any pulling force that would be experienced when removing the space access device as a whole from its position within an internal space or opening.

Alternatively, the lumen 18 may expand to allow it to pass over the lip 64L and then resiliently contract once it has passed over the lip 64L. Further alternatively, there may be a combination action, wherein the lumen 18 expands and the lip 64L compresses when then the securing mechanism 18 passes thereover and then the lumen 18 contracts and the lip 64L expands when the lumen 18 and lip 64L are no longer contacting each other.

Securement of the securing mechanism 10*a*, 10*b*, 10*c* or 10*d* is not limited to the mechanism described above, as securement can be accomplished by a simple friction fit of the components, for example. Further alternatively, additional frictional and/or mechanical interlock enhancements may be provided to facilitate securement, including, but not limited to: tongue and groove features, bayonet-type mechanism, ball and detent arrangements, etc.

The lumen 18 and the portion 64 need not be circular in cross-section, but typically do provide cross-sections that have a mating fit as the securing mechanism 10*a*, 10*b*, 10*c*, or 10*d* id slid over the body of the space access device. Thus the cross-sectional shapes may be any of the shaped 2*a*-2*f* described above with regard to shapes of members such as bristles, or any other shapes that allow mateability and slidability of the securing mechanism relative to the body of the space access device, including but not limited to a circular shape, elliptical shape, any polygonal shape, or regular or irregular shape.

Securing mechanism 10*a* (FIG. 2), 10*b* (FIG. 10), 10*c* (FIG. 8), 10*d* (FIG. 15) may secure a space access device that may include an audio signal transmitting device and/or any of the types of space access devices previously mentioned and/or mentioned below. Securing mechanism 10*a*, 10*b*, 10*c*, 10*d* may include adjustable securing members 20 (FIGS. 2, 8), 30 (FIG. 10), 40 (FIG. 15) that form an adjustable securing mechanism and which may be outwardly projecting members that include, but are not limited to, one or more of fins, bristles, blades, protrusions, ridges, grooves, bubbles, balloons, hooks, looped structure, disks, and/or tubes.

The adjustable securing mechanism, 20, 30, 40, is disposed on at least a portion of the base 16 and is configured to contact a surface of an internal space or opening into which said securing mechanism 10*a*, 10*b*, 10*c*, 10*d* is inserted.

The adjustable securing mechanism, by action of the adjustable, outwardly projecting members 20, 30, 40, is configured for positioning and maintaining the base 16 (and a space access device when the securing mechanism is mounted thereon) at a distance from a location along the internal space or opening. Thus, for example, when the securing mechanism is mounted on or attached to an in-ear hearing aid, the adjustable, outwardly projecting members adjust so as to keep the base 16 and the space access securing device located in the internal space or opening so that a distance or gap is provided between the base 16 and the space access device at all locations 360 degrees about the base and space access device.

The adjustable mechanism is configured for positioning and maintaining the base and the space access device at a distance from a location such as an end of the internal space or opening. For example, the adjustable mechanism of the securing mechanism 10*a*, 10*b*, 10*c*, 10*d* may be configured to maintain a distal end of a hearing aid and distal end of the securing mechanism at a predetermined distance relative to the ear drum. As another example, the adjustable mechanism of the mechanism 10*a*, 10*b*, 10*c*, 10*d* may be configured to maintain a proximal end of a hearing aid at a predetermined distance relative to the opening of the ear canal. As another non-limiting example, the mechanism 10*a*, 10*b*, 10*c*, 10*d* may be configured to maintain a passive amplifier of an in-ear hearing mechanism (such as described in U.S. Pat. No. 8,457,337, for example) at a distance, preferably a predetermined distance, from an eardrum.

Figure 14:
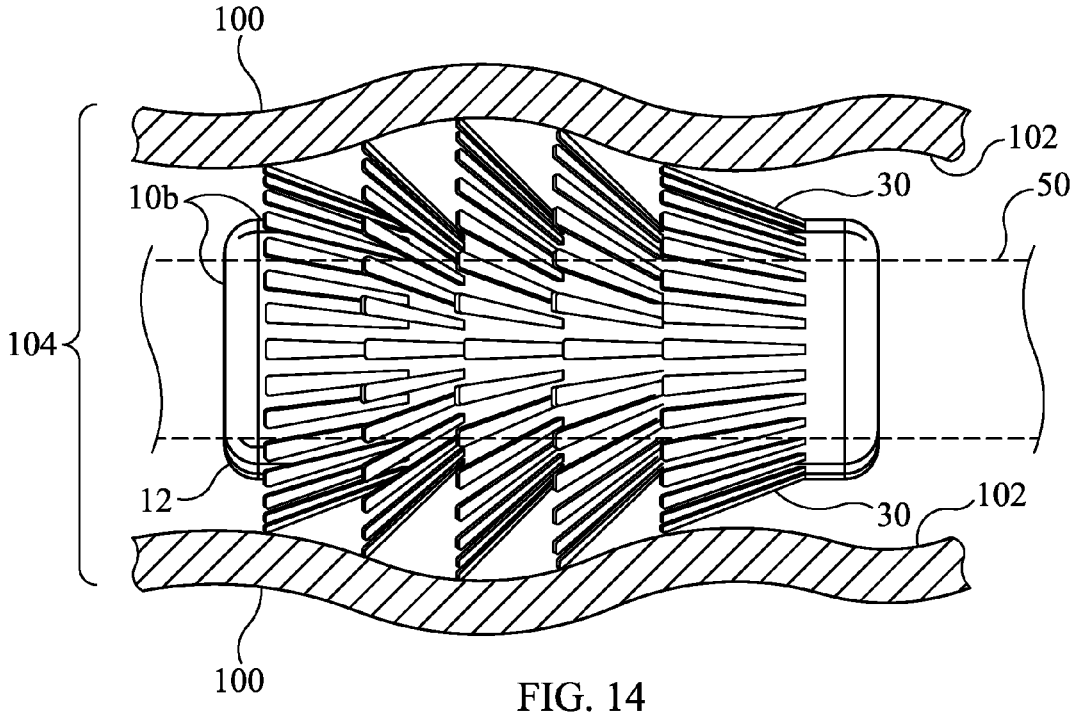
FIG. 14 is an illustration of the securing mechanism shown in FIG. 10 disposed in an internal anatomical space, according to an aspect of the present invention.
Figure 15:
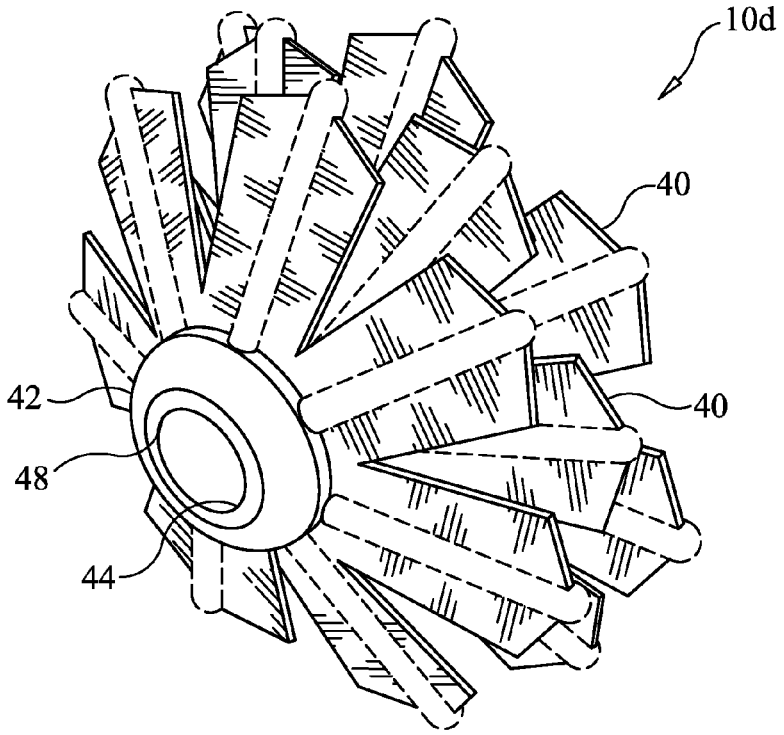
FIG. 15 is a perspective view of another embodiment of a securing mechanism, according to an aspect of the present invention.

The adjustable securing mechanism 10*a*, 10*b*, 10*c*, 10*d* is designed and adapted to conform or self-adjust to the shape of the interior surface of an opening (or interior space) of a member (biological or non-biological) when the securing mechanism (typically, but not necessarily attached to an access device) of the invention and, thereby, the projecting members 20, 30, 40 are inserted in the opening 104 (e.g., see opening and interior space formed by tube 100 in FIG. 14, illustrating an internal anatomical space) thereby putting the projecting members into a constrained configuration. In some embodiments of the invention, each projecting member 20, 30, 40 is adapted to flex and/or deform to conform to the shape and/or size of the interior surface. For example in FIG. 14, the bristles 30 in the more centrally located rows of bristles 30 are constrained less than the bristles 30 in the end rows, because the inside diameter of the opening formed by the walls 102 of the anatomical structure 100 is smaller at the locations of the end rows of bristles 30 than it is at locations of the more central rows of bristles 30. Note that the bristles 30 automatically conform at various levels to keep the space access device 50 substantially centered in the interior space of the anatomical structure, along the entire length thereof. In some embodiments of the invention, one or more member(s) 20, 30, 40 is adapted to flex and/or deform to conform to the shape and/or size of the interior surface.

Figure 4:
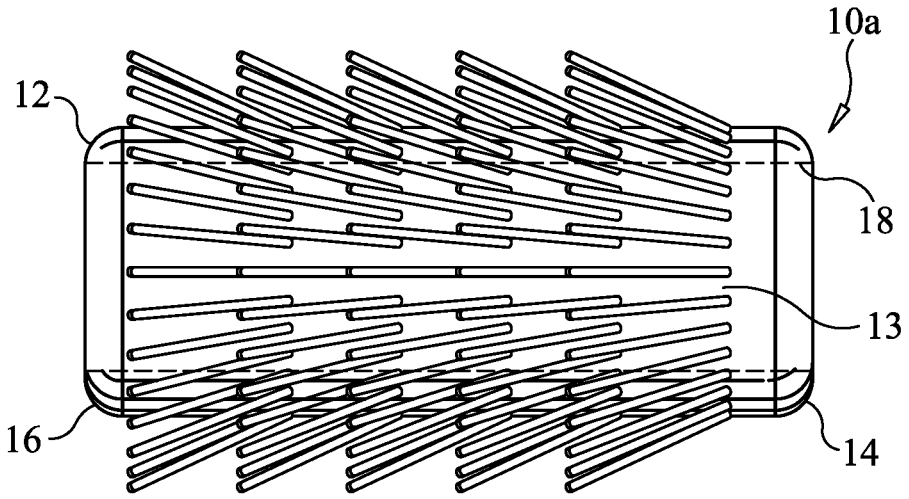
FIG. 4 is a side view of the securing mechanism shown in FIG. 2 in a constrained configuration, according to an aspect of the present invention.
Figure 5:
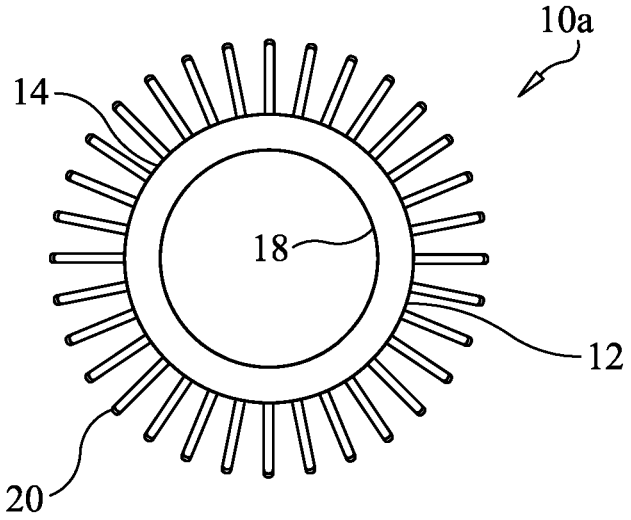

FIGS. 2-3 illustrate an embodiment of the securing mechanism 10*a* wherein the adjustable securing mechanism (outwardly projecting members) are in an unconstrained state, such as when the securing mechanism 10*a* has not yet been inserted into an opening or interior space. FIGS. 4-5 illustrate the securing mechanism 10*a* wherein the adjustable securing mechanism (outwardly projecting members) are in a constrained state and thus do not project out as far as in the unconstrained state of FIGS. 1-2. For example, such a constrained state would be assumed when the securing mechanism 10*a* is inserted into an opening or interior space having an inside diameter or cross-sectional dimension that is less than an outside diameter or cross-sectional dimension of the unconstrained outwardly projecting member 20. Thus, the projecting members 20 are designed and adapted to flex and deform, whereby the securing mechanism 10*a*, 10*b*, 10*c*, 10*d* conforms to the shape of the interior surface 102 of the internal space when the access device 10A is inserted in the opening 104 and the projecting members 20 are in a constrained state.

Thus, at least a portion of the adjustable securing mechanism is configured to transition from a first state to a securing state when inserted into the internal space or opening, wherein the securing state comprises at least a portion of the adjustable securing mechanism being constrained to have a smaller cross-sectional diameter relative to a cross-sectional diameter in the first state.

Figure 6:
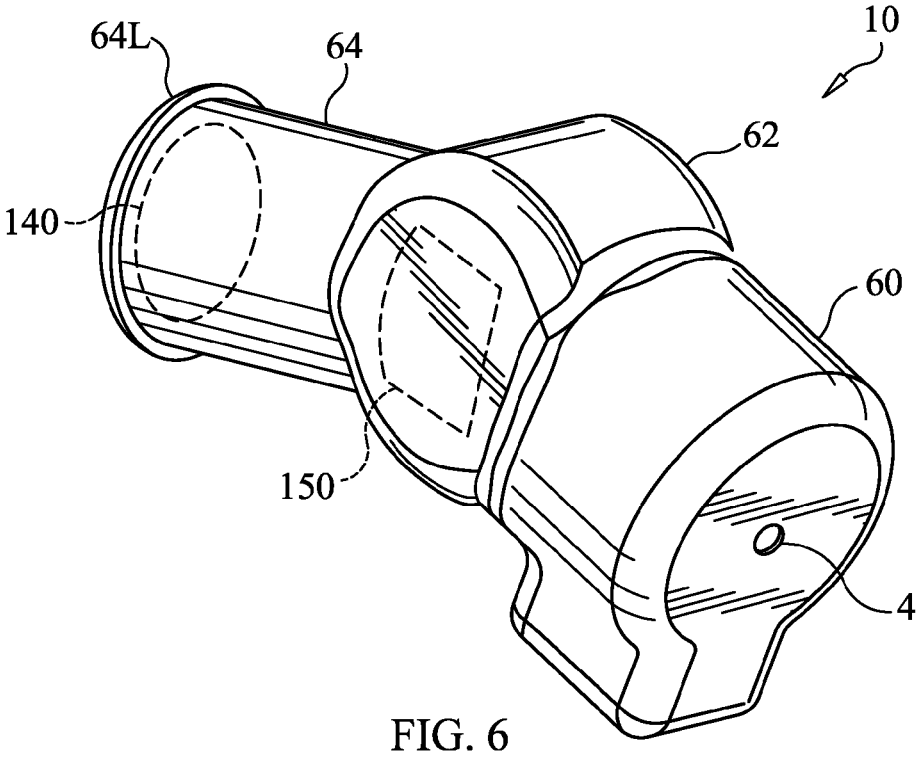
FIG. 6 is a perspective view of an embodiment of a hearing device, according to an aspect of the present invention.
Figure 7:
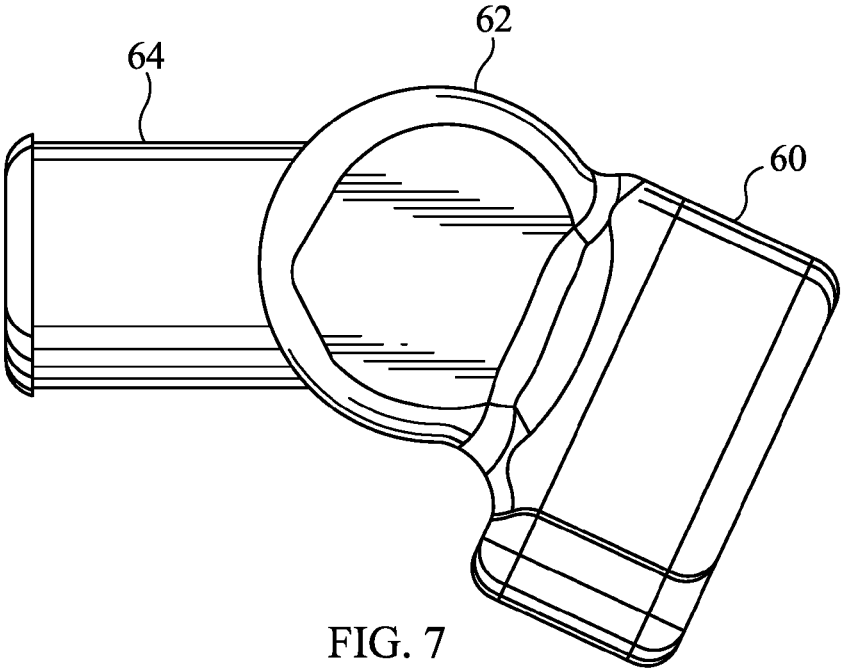
FIG. 7 is a side view of the hearing device shown in FIG. 6.

FIGS. 6 and 7 illustrate an in-ear hearing aid 10 according to an embodiment of the present invention, wherein the in-ear hearing aid 10 is shown without a securing mechanism. Hearing aid 10 comprises a housing which may house electronic components which may include, without limitation, a microphone, a battery, a sound processor, and/or an actuator. The battery or any other energy storage system may provide power to the other electronic components. The microphone may receive and/or collect sound. The sound processor may be used for sound amplification. The actuator may be used for sound transmission to a passive amplifier. In the embodiment shown in FIG. 6, a receiver 140, sound processor 150 and speaker 4 are schematically shown. Thus, the distal end portion 64 of the housing 60 houses the receiver 140, the central portion of the housing 60 houses the sound processor 150 and the speaker opens through the proximal end of the housing 60 in the embodiment of FIG. 6.

Figure 8:
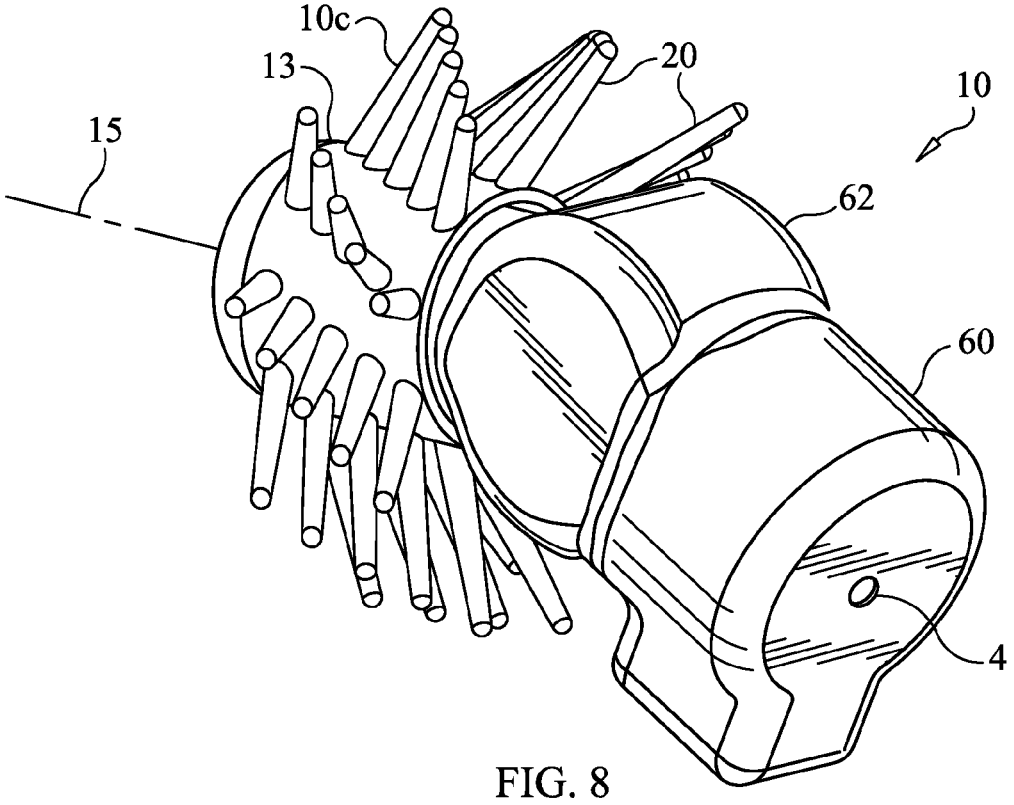
FIG. 8 is a perspective view of the hearing device shown in FIG. 6 having an embodiment of a securing mechanism disposed on the hearing device housing, according to an aspect of the present invention.
Figure 9:
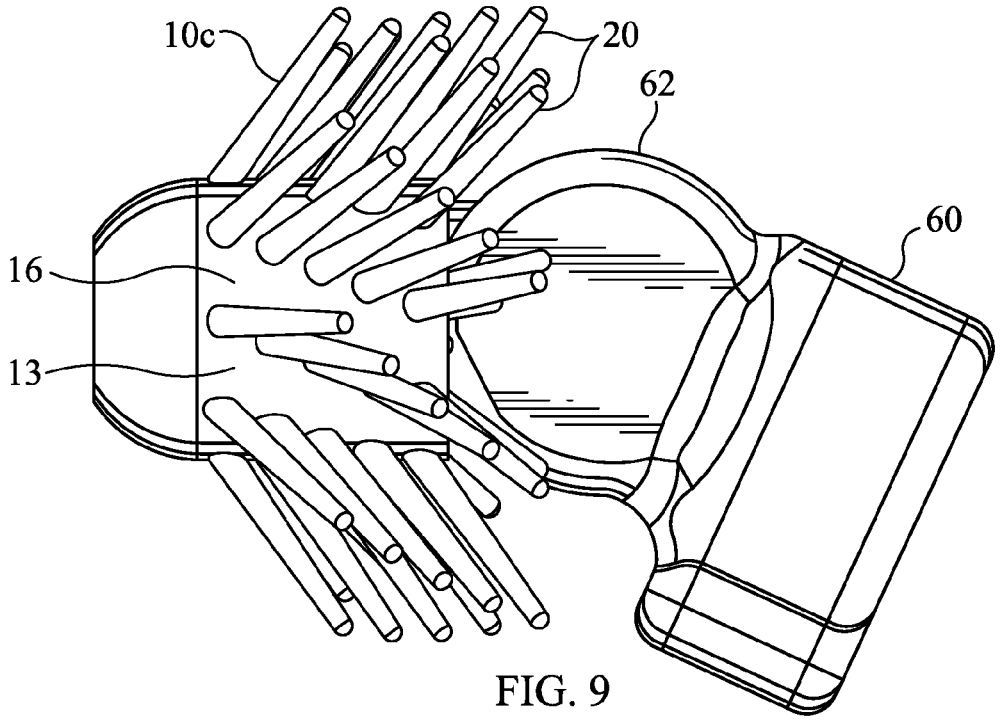
FIG. 9 is a side view of the hearing device shown in FIG. 8.

FIGS. 8-9 illustrate the hearing aid 10 with securing mechanism 10*c* attached thereto. Securing mechanism 10*c* has been attached to the hearing aid 10 in the manner described above, by sliding the securing mechanism 10*c* over the distal end portion 64 of the hearing aid 10 until it passes over the lip 64L in its entirety, whereby the lip 64L secures the securing mechanism in its mounted position on the distal end portion 64 of housing 60. Thus, securing mechanism may secure the hearing aid 10 inside an external ear canal. The securing mechanism 10*c* may secure part or all of the hearing aid 10 inside the ear canal. The securing mechanism 10*c* may also be used to maintain a passive amplifier (not shown) at a desired location or orientation. For example, the securing mechanism 10*c* may keep the passive amplifier in contact with the eardrum. In another example, the securing mechanism 10*c* may keep the passive amplifier at a desired distance from the eardrum. In preferable embodiments, the securing mechanism 10*c* may keep the ear canal open and allow for comfortable extended wear.

The securing mechanism 10*a*, 10*b*, 10*c*, 10*d* may comprise a compressible or flexible portion that may be permeable to air, to secure part or all of a hearing aid 10 while maintaining the ear canal open. The securing mechanism 10*a*, 10*b*, 10*c*, 10*d* may have one or more air channels 13 through the securing mechanism 10*a*, 10*b*,10*c*, 10*d* defined by gaps between the outwardly projecting members 20, 30, 40, or may allow one or more air channels to exist between the securing mechanism and the ear canal when the hearing aid is in use. One or more air flow paths may be provided through the hearing aid or between the hearing aid and ear canal surface. One or more air flow paths may provide fluid communication between one side of the hearing aid and an opposing side of the hearing aid. The opposing sides of the hearing aid may be on opposite longitudinal sides of the hearing aid (toward ear drum and away from ear drum) or on opposing lateral sides of the hearing aid.

In at least one embodiment, the securing mechanism 10*a*, 10*b*, 10*c*, 10*d* may include a plurality of small, soft, flexible bristles 20, 30, 40. The flexible bristles 20, 30, 40 may be attached to a part of the hearing aid by attachment of the securing mechanism thereto, or alternatively, the flexible bristles 20, 30, 40 can be secured directly to the housing 60 of the hearing aid or be formed integrally therewith. In some embodiments, the outwardly projecting members 20, 30, 40 may be assembled in a shape that may look like a circular hair brush. The securing mechanism 10*a*, 10*b*, 10*c*, 10*d* may be attached to the distal end portion 64 of the hearing aid 10 only, the central portion 62 only, the proximal end portion of the housing 60 only, or any combination of these. The securing mechanism may be integrally formed on all or a portion of the housing 60 or may be integrally formed to include the base 16 and outwardly projecting members 20, 30, 40 or the outwardly projecting members 20, 30, 40 can be securely attached to the base 16.

The securing mechanism may contact a surface of the ear canal. For example, a plurality of flexible bristles 20, 30, 40 may contact a surface of an ear canal when the hearing aid is in use. In some embodiments, the securing mechanism may contact the ear canal surrounding the hearing aid at one or more point. For example, if an axis is defined lengthwise along the hearing aid, the securing mechanism may be provided and/or may contact the ear canal surface at any angle around the lengthwise axis. In some embodiments, the securing mechanism may contact the ear canal at 360 degrees around the axis. Various possible configurations for the securing mechanisms are discussed in greater detail below. Any securing mechanism embodiment described elsewhere herein may be utilized.

According to an aspect of the present invention, the securing mechanisms and/or projecting members thereof can comprise compliant and/or flexible materials, including, without limitation, silicone, rubber, latex, polyurethane, polyamide, polyimide, nylon, paper, cotton, polyester, polyurethane, hydrogel, plastic, feather, leather, wood, and/or shape memory alloy, such as NITINOL® or the like. In some embodiments of the invention, the securing mechanisms and/or projecting members comprise a polymeric material.

In some embodiments of the invention, the securing mechanisms and/or projecting members comprise a coated, preferably, compliant and flexible material. According to an embodiment of the invention, a base material used to make the base 16 and/or outwardly projecting members 20, 30, 40 can be coated with various materials and compositions to enhance the lubricity, alter the friction, adjust the hydrophobicity, or increase the stability in the chemical, environmental, and physical conditions of the target space or opening of the projecting members 20, 30, 40.

The base material can also be coated with or contain various materials to allow for administration of a pharmacological agent or composition to biological tissue. The coating material can thus comprise, without limitation, active agents or drugs, such as anti-inflammatory coatings, and drug eluting materials. The coating material can additionally or alternatively include non-pharmacological agents.

In a preferred embodiment of the invention, the securing mechanisms 10*a*, 10*b*, 10*c*, 10*d* of the invention are designed and adapted to self-conform or self-adjust to the shape of the interior surface of an opening (or interior space) of a member (biological or non-biological) when a space access device of the invention and, thereby, the projecting members 20, 30, 40 are inserted in the opening and thereby placed into a constrained state. In some embodiments of the invention, each projecting member is adapted to flex and/or deform to conform to the shape and/or size of the interior surface. In some embodiments of the invention, one or more member(s) is adapted to flex and/or deform to conform to the shape and/or size of the interior surface.

The outwardly projecting members 20, 30, 40 are preferably bristles, but may be any of the types described above, including combinations of different types of projecting members. In the embodiment of FIGS. 2-5 the outwardly projecting members comprise bristles 20 that are substantially cylindrical in cross-sectional shape and have a substantially constant cross-sectional diameter over the entire lengths thereof. In the embodiment of FIGS. 8-9, the outwardly projecting members comprise bristles 20 that are substantially cylindrical in cross-sectional shape and have a tapering cross-sectional diameter over the entire lengths thereof, such that the bases of the bristles 20 where they attach to the base 16 have the largest diameters and the free ends have the smallest diameters, with a constantly tapering diameter at all locations therealong so as to form cone-shaped bristles 20. In the embodiment of FIGS. 10-13, the outwardly projecting members comprises bristles 30 that have a substantially flat cross-sectional shape 2*f* like that shown in FIG. 1F. In the embodiments of FIGS. 15-22, the outwardly projecting members comprise bristles 40 that have a complex cross-sectional shape that is partially flat and partially V-shaped, with a circular portion intervening. As noted previously, the outwardly projecting members may take on many other various cross-sectional shapes as contemplated within the scope of the present invention.

The outwardly projecting members can be disposed on a single planar row of members 20, 30, 40, multiple planar rows as illustrated by bristles 20 in FIGS. 2 and 4, a single spiral row of outwardly projecting members, multiple spiral rows as illustrated by bristles 20 in FIGS. 8-9 and further in U.S. Design Pat. No. D717,957, which is hereby incorporated herein, in its entirety, by reference thereto or other row configurations arranged with varying degrees of overlap of the outwardly projecting members of one row by outwardly projecting members of an adjacent and subsequent rows.

According to another aspect of the present invention, the securing mechanisms 10*a*, 10*b*, 10*c*, 10*d* can include outwardly projecting members having the same cross-sectional shapes or different cross-sectional shapes, e.g. a first bristle row comprising a first plurality of bristles 20 having a cylindrical cross-sectional shape and a second bristle row comprising a plurality of bristles 30 having a flat cross-sectional shape.

According to another aspect of the present invention, the outwardly projecting members may comprise reinforcement members and surface features that are configured to enhance the lubricity, alter the friction, adjust the hydrophobicity, oleophobicity and/or lipophobicity of the securing mechanism and/or outwardly projecting members associated therewith, and/or support and/or enhance modulation of (i) the pressure applied to a surface of an internal space or opening by a space access device employing a securing mechanism according to an embodiment of the present invention, and/or (ii) pressure waves or audio signals through the securing mechanism and, hence, space access device, and between the space access device and the internal space or opening and, thereby, modulate at least one of an amplitude and a frequency of audio signals/pressure waves transmitted through the internal space or opening when the space access device including the securing means is secured in the internal space or opening.

As hearing loss becomes more severe in a patient, a relatively high maximum stable output needs to be produced by a hearing aid treating such a patient as compared to the maximum stable output required of a hearing aid treating a patient with less severe hearing loss. In order to improve maximum stable output of a hearing aid device (maximum output or loudness before feedback occurs to an extent to produce undesirable effects), feedback reduction considerations are an important factor to be taken into account. When a hearing aid device such as device 10 in FIG. 8 is secured in the ear canal of a user, sound entering the ear is sensed by the microphone 4, digitally converted and fed forward to the receiver 140 where it is reproduced to the ear drum in an amplified fashion. However, sound reproduced by the receiver may also feed back to the speaker 4 and if this feedback becomes too great, can result in unpleasant and counterproductive effects, such as squelch, squealing, or just lessened maximum stable output of the device 10 in general. The more "open" an in-ear device is, the greater the propensity for feedback, so there is a tradeoff between "openness", i.e., the amount and directionality of air flow that is allowed to pass through the ear canal between the device 10 and the inner walls of the ear canal, and feedback experienced by the speaker 4.

The independent flexi-fibers, such as bristles 20, 30, 40 conform to each individual's ear canal and are comfortable to wear over extended periods of time as they do not create "pressure spots" of relatively greater force generated by any one portion of the securing mechanism, as occurs in many prior art devices, but distribute the securing forces lightly and substantially evenly over all of the bristles. This conformation forms to any shape ear canal. Also a hearing aid employing securing mechanism according to the present invention is more secure because the outwardly projecting members 20, 30, 40 move with the movements of the wearer's jaw so that the hearing aid device 10 does not become displaced, but remains in the same relative insertion location.

By allowing air to move in and out of the ear canal past the secured hearing aid 10, this allows for temperature and moisture control within the ear canal, providing significantly more comfort to the wearer and a healthier environment for the ear canal as it helps prevent maceration of the ear canal. The flexible bristles 20, 30 and 40 and orientation thereof relative to the hearing aid device 10 when fixed thereto provides for asymmetrical forces applied to the bristles 20,30,40 when comparing insertion of the hearing aid to removal of the hearing aid. As the hearing aid 10 is inserted into the ear canal the angulation and directionality of the bristles 20, 30, 40 causes them to compress relatively easily with a relatively less amount of force compared to the force that is applied to the bristles 20,30,40 as the bristles 20,30,40 have relatively large forces applied to them as they attempt to re-expand as they are being drawing out of the ear canal. This force disparity is beneficial for ease of insertion and placement of the hearing aid 10 and for assistance in wax removal upon removing the hearing aid 10 from the ear canal.

The multiple rows of outwardly projecting members not only aids in linear retention of the space access device when securing it within an internal space, but also aids in angular retention and stability about axes perpendicular to the longitudinal axis 15, as the contact points of the outwardly projecting members extend along the longitudinal axis direction.

In terms of sound, by preventing occlusion of the ear canal, this also avoids the wearer inadvertently speaking too loudly, i.e., reduces what is commonly referred to as the occlusion effect. Generally, the more open the hearing aid device is, the lower the occlusion effect. The openness of the hearing aid allows sound to pass through the device, which is particularly beneficial with regard to low frequencies of sound. The physical dimensions of the speaker 4 render it physically unable to reproduce sounds in the lower frequency ranges with fidelity. Therefore the pass through of these lower frequencies and even some mid frequencies supplements the amplified higher frequencies outputted by the receiver 140 to result in a better fidelity reproduction of the sound that enters the ear canal as it is delivered to the eardrum. Typically patients experience hearing loss mostly in the higher frequency ranges and this is well suited to the functioning of an open in-ear hearing aid described above.

The most open designs of the securing mechanisms are those that allow straight through channels that are aligned with the longitudinal axis of the ear canal and/or hearing aid device 10/securing mechanism 10*a*. For example, in the arrangement shown in FIG. 2 it can be seen that straight through open air channels 13 are provided that are aligned with the longitudinal axis 15 of the securing mechanism 10*a*. This arrangement is very non-occlusive and allows all frequencies of sound to easily pass through the channels 13, both forward and backward, which allows a greater propensity for feedback effects, but at the same time provides for a very comfortable fit.

The design of the securing mechanism 10*c* in FIG. 8 is a spiral design in which no straight through channels are provided that are aligned with the longitudinal axis 15. Instead the channels 13 are occluded in the straight through directions aligned with the longitudinal axis. However the spiral channels 13 are fairly wide as the straight through paths are not fully occluded until the fourth row of bristles 20 is reached. These fairly wide channels still allow some feedback of relatively higher frequencies of sound. The bristles 30 of the embodiment of FIG. 10 are also arranged like the embodiment of FIG. 2, such that straight through paths 13 aligned with the longitudinal axis 15 of the securing mechanism 10*b* are provided However, because the bristles 30 have a flat cross-sectional shape 1F and are wider than the diameters of the cylindrical bristles 20 of FIG. 2, the gaps between the bristles 30 are narrower than the gaps between the bristles 20 in FIG. 2 and the embodiment of FIG. 10 therefore occludes more than the embodiment of FIG. 2. However due to the straight through pathways 13 in FIG. 10 there is some feeding forward and back of higher frequency sound, though less than is the case with the embodiment of FIG. 2.

Since high frequency sound waves are more directional than midrange frequencies and much more directional that low frequency sound waves, it is beneficial to provide a hearing aid device with a securing mechanism that has performs a differential acoustic impedance. Because the spiral channels 13 of the embodiment of FIG. 8 do not provide any straight through channels that are aligned with the longitudinal axis of the ear canal/hearing aid device 10, this causes some of the high frequency soundwaves to be deflected and impeded by the bristles 20 defining the curved channels as the shorter wave, higher frequency sound waves try to pass in a straight through direction aligned with the longitudinal axis 15 of the ear canal/hearing aid device 10. Advantageously, low and midrange sound frequencies are still allowed to pass and thereby supplement the sound reproduction, in a manner as described above. In the feedback direction, the higher frequency sounds emitted from the receiver are also impeded somewhat, thereby reducing contributions to undesirable feedback effects, as these typically occur when the higher frequency soundwaves reproduced by the receiver 140 get fed back to the speaker too much.

A securing mechanism can be provided that completely occludes the ear canal by providing the securing mechanism with one or more disks or domes that interface with the ear canal in a way that completely seals it off. While this is good for feedback reduction, it introduces a lot of the problems that the open air hearing aid overcomes, as it introduces the occlusion effect, does not allow for the temperature and moisture control provided by the open air hearing aids and is generally less comfortable to wear.

In order to obtain an acceptable tradeoff between increasing the maximum stable output of a hearing aid design to allow treatment of more severe cases of hearing loss, and the benefits of open air design as described above, hearing aids 10 having securing mechanism that provide greater differential acoustic impedance than those embodiments described previously. As the pathways 13 deviate more and more from straight line pathways aligned with the longitudinal axis 15 of the ear canal/hearing aid device 10, the differential acoustic impedance increases more and more. One way of increasing this deviation is to reduce the straight line distance before a pathway becomes occluded. In the embodiment of FIGS. 15-22, the gaps between the bristles 40 in a first row of bristles of the securing mechanism 10*d* are completely occluded (in the straight line, parallel to longitudinal axis 15 sense) by bristles 40 in the next adjacent (i.e., second row) of bristles 40 and that the gaps between the bristles 40 in the second row of bristles are completely occluded by the bristles 40 in the third row of bristles. This results in very tortuous pathways 13 (see FIG. 21) through which the air and sound waves travel. As a result, although air flow is still allowed into and out of the ear canal to obtain the benefits of an open in-ear hearing aid described previously, the amount of attenuation of high frequency sound waves is quite high, resulting in greater maximum stable output compared to those embodiments described previously.

One factor in achieving greater differential acoustic impedance is the length of the straight line pathways aligned with the longitudinal axis before occlusion occurs. Because the embodiment of FIG. 15 already occludes by the distance that it takes to reach only the second row of bristles 40, this results in very good differential acoustic impedance. The securing mechanism 10*d* in FIG. 15 includes a lumen 48 that is configured to slide over a mating portion of a space access device in any of the same manners described above with regard to lumen 18 of FIGS. 2-5, with the proximal end portion 46 (see FIG. 17) of the securing mechanism 10*d* being slid over the space access device portion before the distal end portion 42. The distal end component 44 may interface with the lip 64L to prevent inadvertent removal of the securing mechanism 10*d* from a space access device once it has been secured in place.

Figure 16:
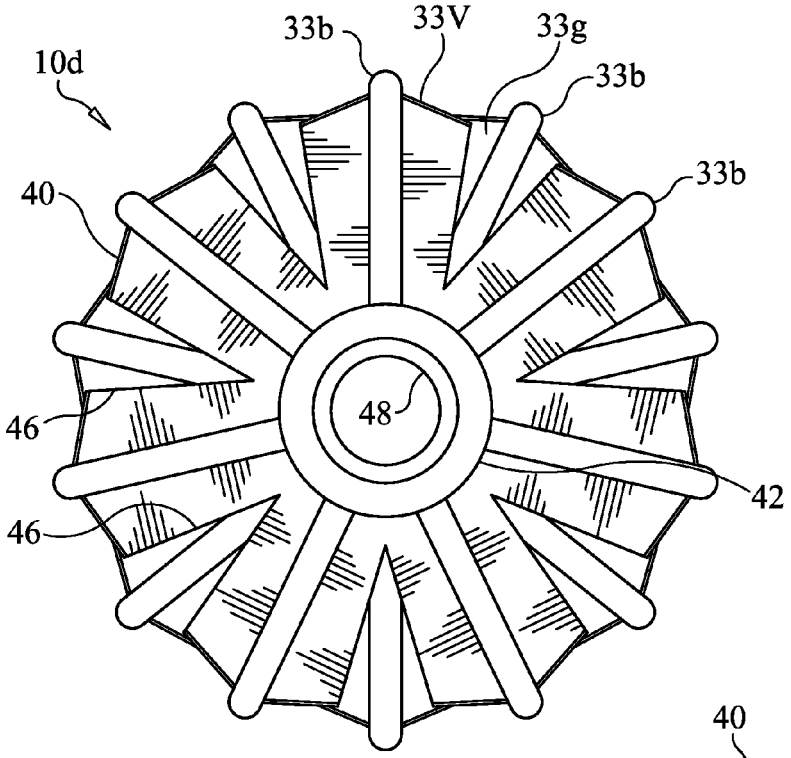
FIG. 16 is a front view of the securing mechanism shown in FIG. 15.
Figure 17:
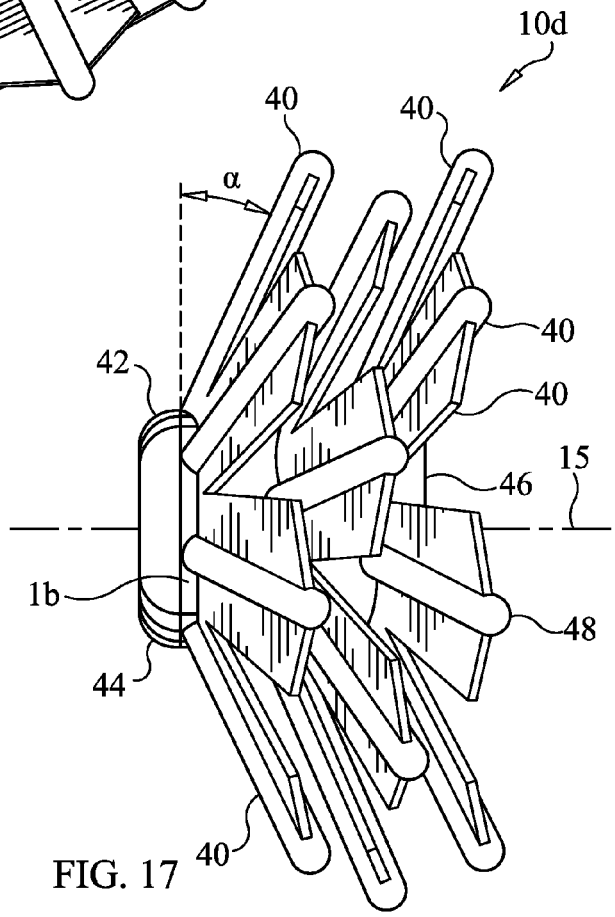
FIG. 17 is a side view of the securing mechanism shown in FIG. 15.

The open area provided by the gaps 33G (see FIG. 16) in a row of outwardly projecting members 40 may be in the range of about 0% to 95% or about 5% to about 50% or about 10% to 40% of the total area defined by the members 40 and gaps 33G as shown in FIG. 16. In the embodiment shown in FIG. 16, the open area, in the unconstrained configuration as shown in about 30%

Figure 18:
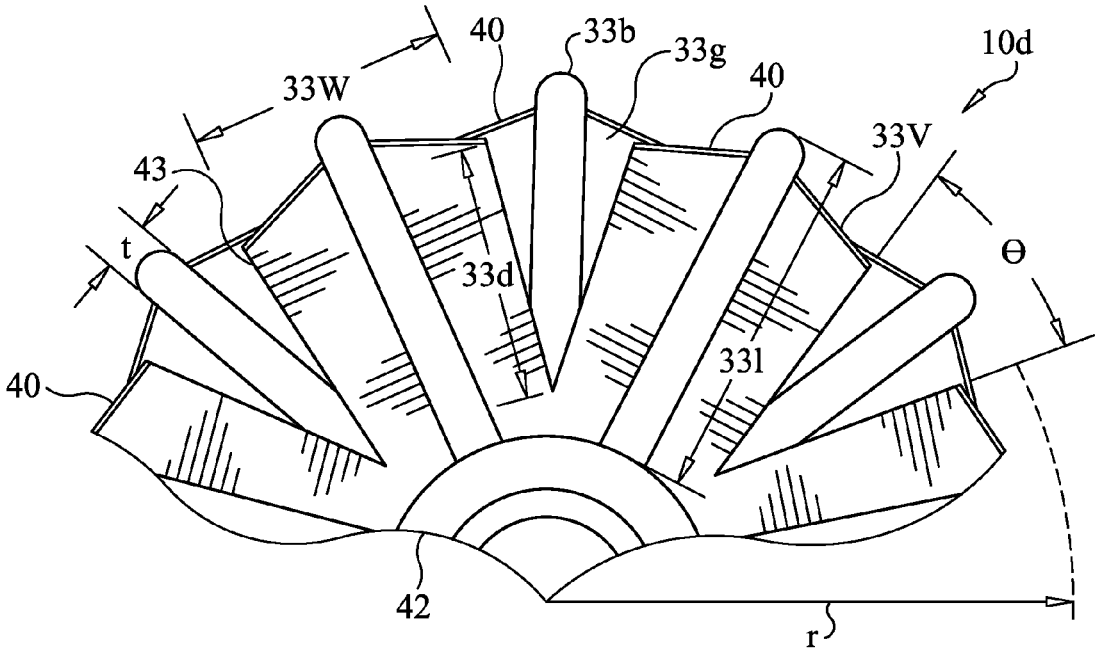
FIG. 18 is a partial front view of the securing mechanism shown in FIG. 15, showing the relationships by and between the securing mechanism bristles, according to an aspect of the present invention.

Additional factors in achieving greater differential acoustic impedance are the width of the bristles and the width of the gaps between the bristles. In the embodiment of FIG. 18, the width 33W of the bristle 40 is a value in a range from about 3.0 mm to 7.0 mm, preferably about 4.0 mm to about 6.0 mm, more preferably about 4.5 mm to about 5.5 mm, and in one specific embodiment was about 5.0 mm. The width of the gaps between the bristles 40 at their widest is a value in a range from about 1 mm to about 5 mm, preferably about 2 mm to 4 mm, more preferably about 2.5 mm to about 3.5 mm and in one specific embodiment was about 3 mm. The angle θ of the gaps may range from about 15 to 45 degrees, more preferably 20 to 40 degrees, and in one embodiment was about 30 degrees. The angle α that the bristles 40 project outwardly at, relative to a normal to the longitudinal axis 15 of the securing mechanism 15 is a value in a range from about 0 degrees to about 60 degrees, preferably about 5 degrees to about 30 degrees, more preferably about 10 degrees to about 25 degrees.

The distance 40*d* between the rows of bristles 40 affects the width of the channel 13 and therefore also directly impacts the amount of high frequency impedance. The distance 40*d* may vary, with narrower distances providing relatively higher high frequency impedance. Width 40*d* is typically a value in the range of about 1 mm to about 3.5 mm, preferably about 1.5 mm to about 2.5 mm and in one specific embodiment was about 2.0 mm.

The bristle members 40 may include sound reducing vanes 33V that are provided on bristle cores 33B as shown in FIG. 16. The bristle cores 33B may be substantially cylindrical (although other cross-sectional shapes may be employed, as noted above) and provide added structural support to the bristle member 40. However, the bristle cores 33B are not strictly necessary, and the bristles may be constructed from a pair of vanes angled with respect to one another like shown, or even as single vanes. The vanes 33V in this embodiment have a thickness that is less that a thickness (e.g., diameter, or other cross-sectional dimension) of the bristle core 33B. The width of the vanes 33V is greater than the width of the bristle core 33B, but need not be in all embodiments. Furthermore, the width of the vane 33V may vary along its length. The lengths 33*d* of the vanes 33V may be equal to, slightly less than, or substantially less than the lengths 331 of the bristle cores 33B. In any case, the securing mechanisms 10*a*, 10*b*, 10*c*, 10*d* are currently made in two sizes, with the large size having an unconstrained diameter having a value in a range from about 13 mm to about 17 mm, preferably from about 14 mm to about 16 mm and in one specific embodiment was about 15 mm. A regular size has an unconstrained diameter with a value in a range from about 10 mm to about 14 mm, preferably about 11 mm to about 13 mm and in one specific embodiment was about 12 mm. the length of bristle core 331 may be a value in a range from about 6 mm to about 9 mm and in one embodiment was about 7 mm. The length 33*d* of vane 33V may be a value in a range from about 5 mm to about 9 mm and in one embodiment was about 6.5 mm. These size ranges are for the regular size and would be respectively larger or the large size. In the embodiment of FIGS. 15-22, all bristle elements 40 are provided with two vanes 33V each. It is within the scope of the present invention that there may be one or more vanes 33V on a bristle core 33B to form a bristle element 40 and/or some bristle elements 40 may have no vanes 33V. An advantage provided by the vanes 33V is the reduction of feedback, as these vanes 33V further assist acoustic feedback reduction in open in-ear hearing aids for users with more severe hearing loss, relative to the amount of hearing loss experienced by users of open in-ear hearing aids that do not employ the vanes 33V.

As noted, various designs and embodiments of the securing mechanism 10*d* may be provided to have variations in: the outwardly projecting member width 33W, gap angle θ, width of gap at its widest, length 33*d* of outwardly projecting members, angle α of outwardly projecting members relative to a normal to the longitudinal axis 15 of the securing mechanism 10*d*, distance between rows of outwardly projecting members in a direction along the longitudinal axis 15, and/or amount of overlap of a gap 33G in one row by an outwardly projecting member 40 in the next adjacent row and subsequent rows, in a direction aligned with the longitudinal axis 15.

In the embodiment of FIGS. 15-22, the gap 33*g* is completely overlapped by member 40 of the next adjacent row as illustrated in FIG. 18, which provides this embodiment with greater differential acoustic impedance performance than an embodiment in which only 95%-99% or 90%-95% or 80% to 90% or 70% to 80% or 60% to 70% or 50% to 60% or less than 50% of the gap 33G is overlapped by the member of the next adjacent row. The greater the degree of overlap, the greater the degree of the differential acoustic impedance is that results. For example, a securing mechanism 10*d* arranged such that a gap 33G in a first row of bristles 40 is completely occluded or overlaid upon reaching the third row of bristles 40 in a straight line direction aligned with the longitudinal axis, will exhibit less differential acoustic impedance that the embodiment shown in FIG. 18, where complete occlusion or overlapping is accomplished by the bristle 40 in the second row of bristles that is immediately adjacent the first row of bristles. Similarly, if a gap 33G is not fully occluded until reaching a bristle 40 in the fourth row of bristles, then this arrangement would provide even less differential acoustic impedance than the example where complete occlusion occurs by the third row. There is a continuum of the amount of differential acoustic impedance that can be achieved by a securement mechanism as described herein, with one of the factors that the continuum is dependent upon being the amount of overlapping or occlusion of a gap 33G by next adjacent row and subsequent row bristles 40. In addition to the physical arrangement and location of the bristles 40 of one row relevant to the next adjacent and subsequent rows, the width 33W of the bristles and gaps 33G also play an important roles in changing the differential acoustic impedance properties, where wider bristles 40 result in greater differential acoustic impedance and narrow gaps 33G result in greater differential acoustic impedance properties.

Also, the differential acoustic impedance characteristics of a securing mechanism increase as the width or cross-sectional dimension of the air channels 13 decreases. Thus, the embodiment of FIG. 17 could be provided with even greater differential acoustic impedance characteristics by moving the rows of the bristles 40 closer together along the direction of the longitudinal axis. Conversely, moving the rows of bristles further apart from on another along the direction of the longitudinal axis 15 would increase the width or cross-sectional dimension of the air channels and thereby decrease the differential acoustic impedance characteristics of the securing mechanism 10*d*.

Figure 19:
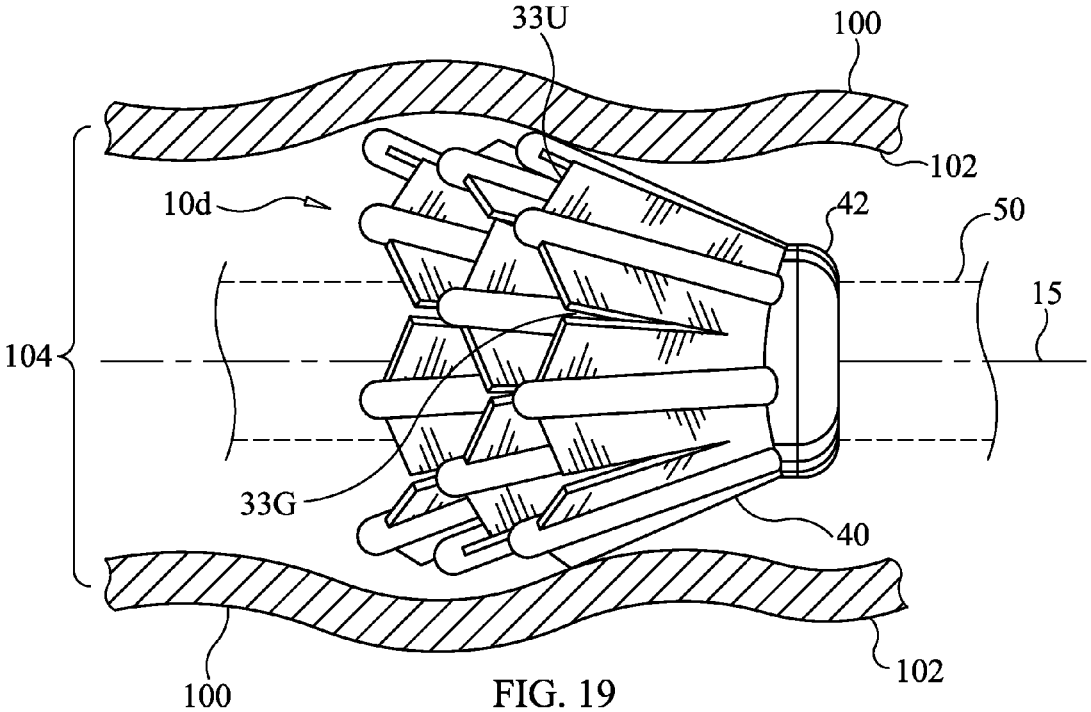
FIG. 19 is an illustration of the securing mechanism shown in FIG. 15 disposed in an internal anatomical space, according to an aspect of the present invention.
Figure 20:
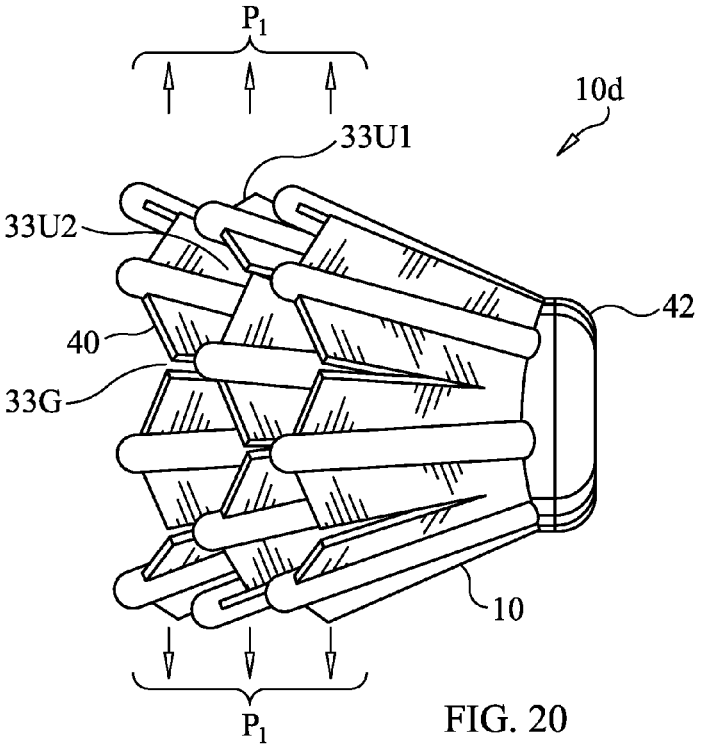
FIG. 20 is a side view of the securing mechanism shown in FIG. 15 in a constrained configuration, illustrating the applied force or pressure profile provided thereby, according to an aspect of the present invention.

FIG. 19 schematically illustrates the 10*d* attached to a space access device 50 having been inserted in the opening 104 (e.g., see opening and interior space formed by tube 100 in FIG. 19, illustrating an internal anatomical space) thereby putting the outward projecting members 40 into a constrained configuration. In some embodiments of the invention, each projecting member 40 is adapted to flex and/or deform to conform to the shape and/or size of the interior surface. For example in FIG. 19, the bristles 40 in the first or distal most row of bristles expand more toward the bottom wall 102 in FIG. 19 than the amount of expansion toward the top wall 102, relative to the longitudinal axis 15, as the bottom wall 102 deviates further from the longitudinal axis than the top wall 102 does at the locations where the bristles 40 of the first row contact the walls 102 and the bristles conform to the shape or topography of the anatomical structure, thereby maintaining the device 50 centered and aligned within the space. The same principles apply to the second and third rows of bristles 40 in FIG. 19. In the compressed/secured configuration it is noted that the gaps 33G become narrower in width as compared to their widths in the initial, non-compressed state, prior to inserting the device. It is further noted that additional air gaps 33U can open up upon the folding inwardly of the vanes 33V toward one another when the securing mechanism is compressed, as illustrated in FIGS. 19 and 20. However, by designing the bristles 40 such that adjacent rows of bristles 40 fold in opposite directions 33U1, 33U2, this counteracts the opening up of new air channels as adjacent folded vanes 33V fill in or overlay the gaps to a great extent.

Figure 21:
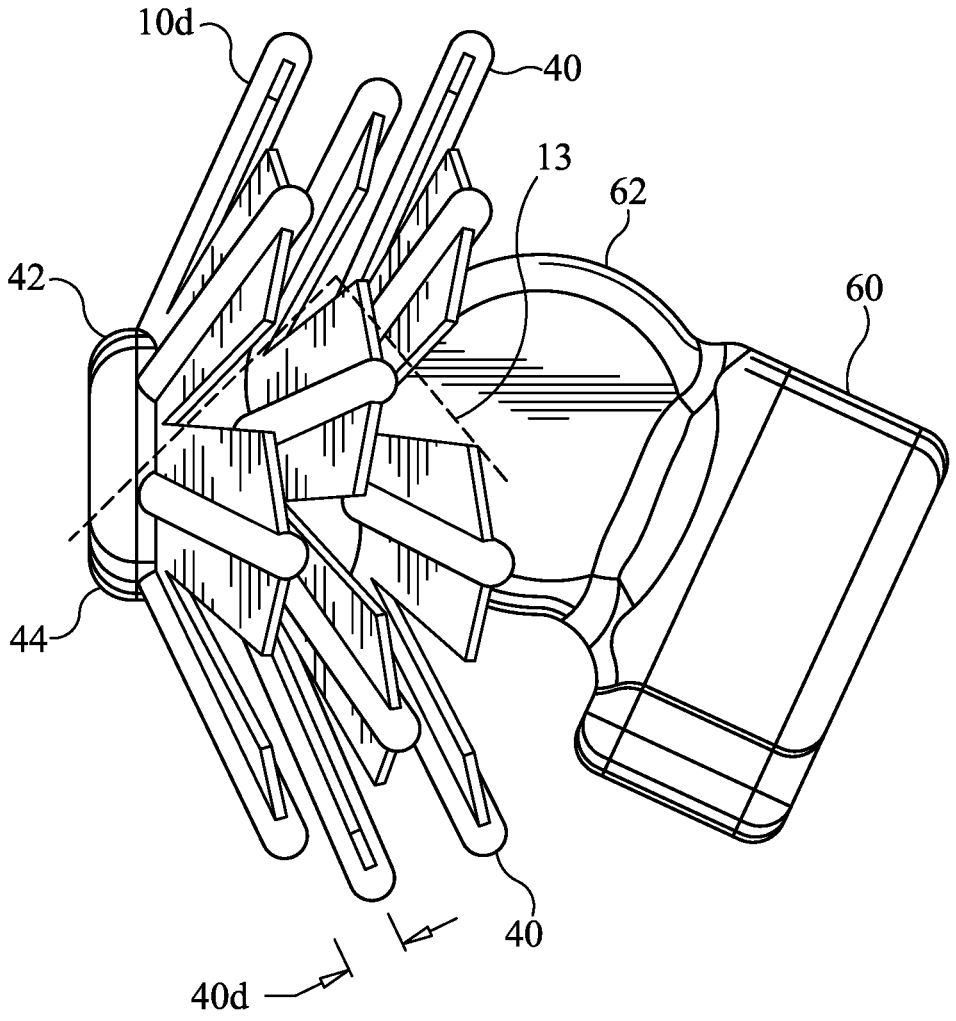
FIG. 21 is a side view of the hearing device shown in FIG. 6 having the securing mechanism shown in FIG. 15 disposed thereon, according to an aspect of the present invention.

FIG. 21 illustrates a securing mechanism 10*d* having been removably attached to a distal end portion of a hearing aid device 60 according to an embodiment of the present invention. As mentioned previously, the outwardly projecting members 40 could alternatively be permanently mounted to extend from the housing of the hearing aid device 60 or be made integral therewith.

FIG. 22. illustrates a securing mechanism 10*d* having been removably attached to a distal end portion of a housing 72 of headphone 70 according to an embodiment of the present invention. As mentioned previously, the outwardly projecting members 40 could alternatively be permanently mounted to extend from the housing 72 of the headphone 70 or be made integral therewith.

Figure 23:
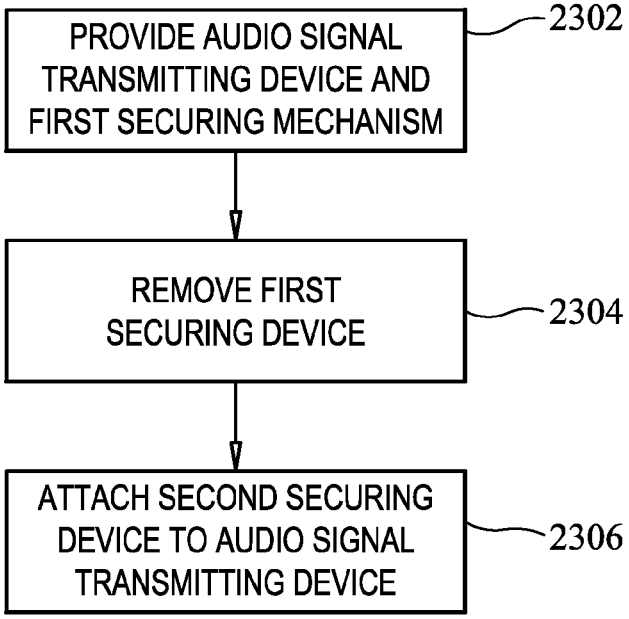
FIG. 23 illustrates events that may be carried out in a method to change operating characteristics of a space access device according to an embodiment of the present invention.

FIG. 23 illustrates events that may carried out to effect a method of changing at least one of: differential acoustic impedance, modulation of amplitude and/or modulation of frequency of audio signals provided by a space access device such as an audio signal transmitting device when inserted into an opening or internal space as described herein.

At event 2302, an audio signal transmitting device is provided. The audio signal transmitting device may be provided with a first securing mechanism 10*a*, 10*b*, 10*c*, 10*d* already attached thereto, or a user may attach the first securing mechanism to the audio signal transmitting device. The first securing mechanism is configured to perform, in conjunction with the audio signal transmitting device, at least one of: differential acoustic impedance of the audio signals, modulation of an amplitude of the audio signals, or modulation of frequency of the audio signals transmitted through the internal space or opening when said securing means is secured in the internal space or opening, by providing the first securing mechanism in accordance with one of the embodiments described herein.

If the user wants to change one of these characteristics, for example to increase maximum stable output or to increase the amount of airflow past the securing mechanism and audio signal transmitting device when installed in the opening or internal space, then the first securing mechanism 10*a*, 10*b*, 10*c*, 10*d* is removed from the audio signal transmitting device at event 2304. At event 2306, a second securing mechanism 10*a*, 10*b*, 10*c*, 10*d* is attached to the audio signal transmitting device, wherein the second securing mechanism is configured to perform at least one of: a second differential acoustic impedance of; a second modulation of an amplitude of, or a second modulation of a frequency of audio signals transmitted through the internal space or opening when the audio transmitting device and securing mechanism are secured in the internal space or opening; and wherein at least one of the second differential acoustic impedance of; second modulation of an amplitude of, or second modulation of a frequency of audio signals transmitted through the internal space or opening when the audio transmitting device and second securing mechanism are secured in the internal space or opening is different from the first differential acoustic impedance of; first modulation of an amplitude of, or first modulation of a frequency of audio signals transmitted through the internal space or opening when the audio transmitting device and first securing mechanism are secured in the internal space or opening.

The different characteristics can be achieved as described herein including changing at least one characteristic of the second securing mechanism relative to the first securing mechanism, where each of the first and second securing mechanisms includes: a plurality of outwardly projecting members arranged in rows; each of the outwardly projecting members comprising a length and a width; gaps separating the outwardly projecting members; the rows being separated by a row distance measured in a direction along a longitudinal axis of the securing mechanisms; the gaps comprising a maximum gap width; the gaps comprising a gap angle; the outwardly projecting members being angled with respect to a normal to the longitudinal axis; and gaps in a first row being overlapped by outwardly projecting members of an immediately adjacent row by a value in a range from 0% to 100% in a direction aligned with the longitudinal axis.

Thus, a set including the characteristics of the length of the outwardly projecting member, width of the outwardly projecting member, row distance, maximum gap width of the gaps, gap angle, angle of the outwardly projecting members with respect to a normal to the longitudinal axis, and overlap of the gaps for the first securing mechanism, is selected to be different from a set including the characteristics of the length of the outwardly projecting member, width of the outwardly projecting member, row distance, maximum gap width of the gaps, gap angle, angle of the outwardly projecting members with respect to a normal to the longitudinal axis, and overlap of the gaps for the second securing mechanism.

In at least one embodiment, the overlap of one of the first and second securing mechanisms is 100%.

While the present invention has been described with reference to the specific embodiments thereof, it should be understood by those skilled in the art that various changes may be made and equivalents may be substituted without departing from the true spirit and scope of the invention. In addition, many modifications may be made to adapt a particular situation, material, composition of matter, process, process step or steps, to the objective, spirit and scope of the present invention. All such modifications are intended to be within the scope of the claims appended hereto.

That which is claimed is:

1. A securing mechanism for an audio signal transmitting device, comprising:

a base comprising a longitudinal axis and an outer surface; and an adjustable securing mechanism disposed on at least a portion of said base, said securing mechanism being configured to contact a surface of an internal space or opening into which said securing mechanism is inserted;

said adjustable securing mechanism being configured for positioning and maintaining said base at a distance from a location along the internal space or opening; and wherein a least a portion of said adjustable securing mechanism being configured to transition from a first state to a securing state when inserted into the internal space or opening, said securing state comprising at least a portion of said adjustable securing mechanism being constrained to have a smaller cross-sectional diameter relative to a cross-sectional diameter in said first state; and wherein said adjustable securing mechanism comprises a plurality of members, each of said plurality of members having a width in a direction circumferentially about said base greater than a depth in a direction of the longitudinal axis of said base.

2. The securing mechanism of claim 1, wherein said adjustable securing mechanism comprises a plurality of members, at least some of said members comprising at least one of: bristles, protrusions, ridges, grooves, blades, bubbles, hooks and tubes.

3. The securing mechanism of claim 1, wherein said adjustable securing mechanism is configured to allow external sound to be transmitted therepast when said securing mechanism is secured in the internal space or opening.

4. The securing mechanism of claim 1 installed on an in-the-ear hearing aid.

5. The securing mechanism of claim 1 installed on an earpiece speaker.

6. The securing mechanism of claim 1, wherein said adjustable securing mechanism is configured to self-adjust to a shape of the internal space or opening when said securing mechanism is secured in the internal space or opening.

7. The securing mechanism of claim 1, wherein said adjustable securing mechanism is configured to conform to a shape of the internal space or opening when said securing mechanism is secured in the internal space or opening.

8. The securing mechanism of claim 1, wherein said adjustable securing mechanism is configured to modulate at least one of an amplitude and a frequency of audio signals transmitted through the internal space or opening when said securing means is secured in the internal space or opening.

9. The securing mechanism of claim 1, wherein said adjustable securing mechanism provides differential acoustic impedance when used in conjunction with said audio signal transmitting device and inserted in the internal space or opening.

10. A kit comprising a plurality of securing mechanisms for an audio signal transmitting device, each said securing mechanism comprising:

a base comprising a longitudinal axis and an outer surface; and an adjustable securing mechanism disposed on at least a portion of said base, said securing mechanism being configured to contact a surface of an internal space or opening into which said securing mechanism is inserted;

wherein each of said adjustable securing mechanisms is configured to perform at least one of: differential acoustic impedance of; modulation of an amplitude of, or modulation of a frequency of audio signals transmitted through the internal space or opening when said securing mechanism is secured in the internal space or opening; and wherein an amount of said at least one of differential acoustic impedance, modulation of amplitude and/or modulation of frequency of audio signals provided by each said securing mechanism is different from an amount of said at least one of differential acoustic impedance, modulation of amplitude and/or modulation of frequency of audio signals by each of the others of said securing mechanisms.

11. The kit of claim 10, wherein at least a portion of each said adjustable securing mechanism is configured to transition from a first state to a securing state when inserted into the internal space or opening, said securing state comprising at least a portion of said adjustable securing mechanism being constrained to have a smaller cross-sectional diameter relative to a cross-sectional diameter in said first state.

12. The kit of claim 10, wherein each of said adjustable securing mechanisms comprises a plurality of outwardly projecting members projecting outwardly from said base and gaps formed between said outwardly projecting members, wherein at least one of a width of said gaps and a width of said outwardly projecting members in a first one of said adjustable securing mechanisms is different from a respective width of said gaps or width of said outwardly projecting members of another of said adjustable securing members.

13. The kit of claim 10, wherein each of said adjustable securing mechanisms comprises a plurality of outwardly projecting members arranged in rows and projecting outwardly from said base, wherein a distance between said rows of a first adjustable securing mechanism is different from a distance between said rows of a second adjustable securing mechanism, wherein said distances are measured in a direction along a longitudinal axis of said securing mechanisms.

14. The kit of claim 10, wherein each of said adjustable securing mechanisms comprises a plurality of outwardly projecting members arranged in rows, with said outwardly projecting members in at least one of said rows being separated by gaps; and wherein a first amount of overlap of said gaps in said at least one of said rows, by outwardly projecting members in a row immediately adjacent said at least one of said rows in a first one of said adjustable securing mechanisms is different from a second amount of overlap of said gaps in said at least one of said rows, by outwardly projecting members in a row immediately adjacent said at least one of said rows in another one of said adjustable securing mechanisms.

15. The kit of claim 10, wherein each of said adjustable securing mechanisms comprises a plurality of outwardly projecting members arranged in rows;

wherein said outwardly projecting members comprise a length and a width;

wherein gaps separate said outwardly projecting members;

wherein said rows are separated by a row distance measured in a direction along a longitudinal axis of said securing mechanisms;

wherein said gaps comprise a maximum gap width;

wherein said gaps comprise a gap angle;

wherein said outwardly projecting members are angled with respect to a normal to the longitudinal axis;

wherein said gaps in a first row are overlapped by outwardly projecting members of an immediately adjacent row by a value in a range from 0% to 100% in a direction aligned with the longitudinal axis; and wherein a set including the characteristics of the length of the outwardly projecting member, width of the outwardly projecting member, row distance, maximum gap width of said gaps, gap angle, angle of said outwardly projecting members with respect to a normal to the longitudinal axis, and overlap of said gaps for each said adjustable securing mechanism, is selected to be different from sets including the characteristics of the length of the outwardly projecting member, width of the outwardly projecting member, row distance, maximum gap width of said gaps, gap angle, angle of said outwardly projecting members with respect to a normal to the longitudinal axis, and overlap of said gaps for all other of said adjustable securing mechanisms.

16. A securing mechanism for an audio signal transmitting device, said securing mechanism comprising:

a base comprising a longitudinal axis and an outer surface; and an adjustable securing mechanism disposed on at least a portion of said base, said securing mechanism being configured to contact a surface of an internal space or opening into which said securing mechanism is inserted;

wherein said adjustable securing mechanism comprises rows each comprising a plurality of outwardly projecting members separated by gaps, wherein said gaps in a first of said rows are overlapped by said outwardly projecting members of an immediately adjacent row by an amount greater than 50% of the gap, in a direction aligned with the longitudinal axis;

wherein said gaps, in combination with spaces between said rows, form non-straight through channels relative to the longitudinal axis when said securing mechanism is positioned in the internal space or opening.

17. The securing mechanism of claim 16; wherein said gaps in said first row are overlapped 100% by said outwardly projecting members of said immediately adjacent row.

18. The securing mechanism of claim 16 installed on an in-the-ear hearing aid.

19. The securing mechanism of claim 16 installed on an earpiece speaker.

20. The securing mechanism of claim 16, wherein said adjustable securing mechanism is configured to perform at least one of: differential acoustic impedance of; modulation of an amplitude of, or modulation of a frequency of audio signals transmitted through the internal space or opening when said securing means is secured in the internal space or opening.

21. An audio signal transmitting device comprising:

a base member including at least one electronic component configured to transmit an audio signal; and an adjustable securing mechanism disposed on at least a portion of said base, said securing mechanism being configured to contact a surface of an internal space or opening into which said securing mechanism is inserted;

wherein said adjustable securing mechanism comprises rows each comprising a plurality of outwardly projecting members separated by gaps, wherein said gaps in a first of said rows are overlapped by said outwardly projecting members of an immediately adjacent row by an amount greater than 50% of the gap, in a direction aligned with the longitudinal axis; and wherein said gaps, in combination with spaces between said rows, form non-straight through channels relative to the longitudinal axis when said securing mechanism is positioned in the internal space or opening.

22. The audio signal transmitting device of claim 21; wherein said gaps in said first row are overlapped 100% by said outwardly projecting members of said immediately adjacent row.

23. The audio signal transmitting device of claim 21, wherein said base member comprises an in-the-ear hearing aid.

24. The audio signal transmitting device of claim 21, wherein said base member comprises an earpiece speaker.

25. The audio signal transmitting device of claim 21, wherein said adjustable securing mechanism is removably attachable to said base member.

26. The audio signal transmitting device of claim 21, wherein said adjustable securing mechanism is permanently attached to said base member.

27. The audio signal transmitting device of claim 21, wherein said adjustable securing mechanism is integral with said base member.

28. A method of changing at least one of characteristics of an audio signal transmitting device when inserted into an internal space or opening, wherein said characteristics include: differential acoustic impedance of the audio signals, modulation of an amplitude of the audio signals, or modulation of frequency of the audio signals transmitted through the internal space or opening when said securing means is secured in the internal space or opening, said method comprising:

providing the audio signal transmitting device with a first securing mechanism attached thereto and configured to contact a surface of an internal space or opening into which said securing mechanism is inserted, wherein the first securing mechanism is configured to perform at least one of: a first differential acoustic impedance of; a first modulation of an amplitude of, or a first modulation of a frequency of audio signals transmitted through the internal space or opening when the audio transmitting device and first securing mechanism are secured in the internal space or opening;

removing the first securing mechanism from the audio signal transmitting device; and attaching a second securing mechanism to the audio signal transmitting device, wherein the second securing mechanism is configured to perform at least one of: a second differential acoustic impedance of; a second modulation of an amplitude of, or a second modulation of a frequency of audio signals transmitted through the internal space or opening when the audio transmitting device and securing mechanism are secured in the internal space or opening; and wherein at least one of said second differential acoustic impedance of; second modulation of an amplitude of, or second modulation of a frequency of audio signals transmitted through the internal space or opening when the audio transmitting device and second securing mechanism are secured in the internal space or opening is different from said first differential acoustic impedance of; first modulation of an amplitude of, or first modulation of a frequency of audio signals transmitted through the internal space or opening when the audio transmitting device and first securing mechanism are secured in the internal space or opening.

29. The method of claim 28, wherein each of said first and second securing mechanisms comprises a plurality of outwardly projecting members arranged in rows;

wherein said outwardly projecting members comprise a length and a width;

wherein gaps separate said outwardly projecting members;

wherein said rows are separated by a row distance measured in a direction along a longitudinal axis of said securing mechanisms;

wherein said gaps comprise a maximum gap width;

wherein said gaps comprise a gap angle;

wherein said outwardly projecting members are angled with respect to a normal to the longitudinal axis;

wherein said gaps in a first row are overlapped by outwardly projecting members of an immediately adjacent row by a value in a range from 0% to 100% in a direction aligned with the longitudinal axis;

wherein a set including the characteristics of the length of the outwardly projecting member, width of the outwardly projecting member, row distance, maximum gap width of said gaps, gap angle, angle of said outwardly projecting members with respect to a normal to the longitudinal axis, and overlap of said gaps for said first securing mechanism, is selected to be different from a set including the characteristics of the length of the outwardly projecting member, width of the outwardly projecting member, row distance, maximum gap width of said gaps, gap angle, angle of said outwardly projecting members with respect to a normal to the longitudinal axis, and overlap of said gaps for said second securing mechanism; and wherein said gaps, in combination with spaces extending over said row distances, form non-straight through channels relative to the longitudinal axis when said securing mechanisms are positioned in the internal space or opening.

30. The method of claim 28, wherein said gaps in a first row of one of said first and second securing mechanisms are overlapped by outwardly projecting members of an immediately adjacent row by a value of 100%.

31. A securing mechanism for an audio signal transmitting device, comprising:

a base comprising a longitudinal axis and an outer surface;

a plurality of outwardly projecting members;

at least a portion of said plurality of outwardly projecting members extending outwardly from said base at a non-zero angle relative to a normal to a longitudinal axis to said base;

wherein at least a portion of said outwardly projecting members are configured to transition from a first state to a securing state when inserted in an internal space and modulate at least one of frequency of audio signals and amplitude of audio signals pass through said plurality of outwardly projecting members; and wherein said outwardly projecting members have an open area having a value in the range from about 5% to 50% when in said first state.

32. The securing mechanism of claim 31, wherein said outwardly projecting members each comprise a length in the range of about 0.1 μm to about 3 cm and a width in the range of about 1.0 μm to about 2 cm.

33. The securing mechanism of claim 31, wherein said modulation occurs in a frequency range of about 10 to 100 kHz.

34. The securing mechanism of claim 31, wherein modulation of amplitude is in a range of about 0.1 dB to about 150 dB.

35. The securing mechanism of claim 31, wherein when said plurality of outwardly projecting members are in said securing state, said outwardly projecting members are configured to apply a pressure to a surface of said internal space in a range of about 0.1 kPa to about 10 kPa.

36. The securing mechanism of claim 31, wherein said outwardly projecting members have an open area less than about 5% when said outwardly projecting members are in said securing state.

37. The securing mechanism of claim 31, wherein said outwardly projecting members have an open area less than about 5% when said securing mechanism performs said at least one modulate function.

38. The securing mechanism of claim 31, wherein said outwardly projecting members each have a width in a direction circumferentially about said base greater than a depth in a direction of the longitudinal axis of said base.

39. The securing mechanism of claim 38, wherein said outwardly projecting members have an open area of about 30% when in said first state.

40. The securing mechanism of claim 31, wherein at least a portion of said plurality of outwardly projecting members comprise triangular-shaped gaps therebetween, each said triangular-shaped gap comprising a depth in the range of about 5% to about 95% of a length of said outwardly projecting members; and wherein each said triangular-shaped gap comprises a gap angle in a range of about 0.5 degrees to about 180 degrees.

41. The securing mechanism of claim 31, wherein at least a portion of said plurality of outwardly projecting members comprises an outer coating comprising a pharmacological composition.

42. The securing mechanism of claim 41, wherein said pharmacological composition comprises an anti-inflammatory agent.

43. A kit comprising a plurality of securing mechanisms for an audio signal transmitting device, each said securing mechanism comprising:

a base comprising a longitudinal axis and an outer surface; and an adjustable securing mechanism disposed on at least a portion of said base, said securing mechanism being configured to contact a surface of an internal space or opening into which said securing mechanism is inserted;

wherein each of said adjustable securing mechanisms is configured to perform at least one of: differential acoustic impedance of; modulation of an amplitude of, or modulation of a frequency of audio signals transmitted through the internal space or opening when said securing mechanism is secured in the internal space or opening;

wherein an amount of said at least one of differential acoustic impedance, modulation of amplitude and/or modulation of frequency of audio signals provided by each said securing mechanism is different from an amount of said at least one of differential acoustic impedance, modulation of amplitude and/or modulation of frequency of audio signals by each of the others of said securing mechanisms;

wherein each of said adjustable securing mechanisms comprises a plurality of outwardly projecting members arranged in rows;

wherein said outwardly projecting members comprise a length and a width;

wherein gaps separate said outwardly projecting members;

wherein said rows are separated by a row distance measured in a direction along a longitudinal axis of said securing mechanisms;

wherein said gaps comprise a maximum gap width;

wherein said gaps comprise a gap angle;

wherein said outwardly projecting members are angled with respect to a normal to the longitudinal axis;

wherein said gaps in a first row are overlapped by outwardly projecting members of an immediately adjacent row by a value in a range from 0% to 100% in a direction aligned with the longitudinal axis; and wherein a set including the characteristics of the length of the outwardly projecting member, width of the outwardly projecting member, row distance, maximum gap width of said gaps, gap angle, angle of said outwardly projecting members with respect to a normal to the longitudinal axis, and overlap of said gaps for each said adjustable securing mechanism, is selected to be different from sets including the characteristics of the length of the outwardly projecting member, width of the outwardly projecting member, row distance, maximum gap width of said gaps, gap angle, angle of said outwardly projecting members with respect to a normal to the longitudinal axis, and overlap of said gaps for all other of said adjustable securing mechanisms.

44. A securing mechanism for an audio signal transmitting device, comprising:

a base comprising a longitudinal axis and an outer surface;

a plurality of outwardly projecting members;

at least a portion of said plurality of outwardly projecting members extending outwardly from said base at a non-zero angle relative to a normal to a longitudinal axis to said base;

wherein at least a portion of said outwardly projecting members are configured to transition from a first state to a securing state when inserted in an internal space and modulate at least one of frequency of audio signals and amplitude of audio signals pass through said plurality of outwardly projecting members; and wherein said outwardly projecting members have an open area having a value of about 30% when in said first state.

* * * * *